US010619827B1

(12) United States Patent
Todd

(10) Patent No.: US 10,619,827 B1
(45) Date of Patent: Apr. 14, 2020

(54) MODULAR CONTROLLABLE LIGHTING FIXTURES

(71) Applicant: BML Productions, Inc., Secaucus, NJ (US)

(72) Inventor: Eric Todd, Old Tappan, NJ (US)

(73) Assignee: BML PRODUCTIONS, INC., Secaucus, NJ (US)

( * ) Notice: Subject to any disclaimer, the term of this patent is extended or adjusted under 35 U.S.C. 154(b) by 0 days.

(21) Appl. No.: 16/653,404

(22) Filed: Oct. 15, 2019

(51) Int. Cl.

| | |
|---|---|
| ***F21V 14/02*** | (2006.01) |
| ***F21V 23/06*** | (2006.01) |
| ***F21V 21/26*** | (2006.01) |
| ***F21V 21/108*** | (2006.01) |
| *F21V 29/77* | (2015.01) |
| *F21Y 103/33* | (2016.01) |
| *F21Y 103/10* | (2016.01) |

(52) U.S. Cl.
CPC ..... *F21V 14/02* (2013.01); *F21V 21/108* (2013.01); *F21V 21/26* (2013.01); *F21V 23/06* (2013.01); *F21V 29/773* (2015.01); *F21Y 2103/10* (2016.08); *F21Y 2103/33* (2016.08)

(58) Field of Classification Search
CPC ..... F21V 14/02; F21V 21/108; F21V 21/26; F21V 23/06; F21V 29/773; F21V 21/00; F21V 23/00; F21V 21/14; F21V 14/00; F21V 17/00; F21V 17/06; F21V 17/04; F21V 17/10; F21V 19/00; F21V 19/001; F21V 19/003; F21Y 2103/33; F21Y 2103/10
See application file for complete search history.

(56) References Cited

U.S. PATENT DOCUMENTS

| | | | | |
|---|---|---|---|---|
| 4,392,187 | A | 7/1983 | Bornhorst | |
| 6,120,164 | A | 9/2000 | Libin et al. | |
| RE43,017 | E | 12/2011 | Belliveau | |
| 9,404,641 | B2 | 8/2016 | Belliveau et al. | |
| 2010/0320932 | A1* | 12/2010 | Ma | F21S 10/00 315/294 |

(Continued)

OTHER PUBLICATIONS

AliExpress.com, "2pcs/lot Top quality fantastic LED BAY15D P21/5W 1157 or P27/7W 3157 led car light brake light 30smd 5630 5730 tail light" (Printed Sep. 23, 2019).

(Continued)

*Primary Examiner* — Bao Q Truong
(74) *Attorney, Agent, or Firm* — Weitzman Law Offices, LLC

(57) ABSTRACT

A lighting fixture involves a base, at least one yoke, and a shaft, a lighting head is coupled to the at least one yoke, wherein the lighting head is controllably rotatably movable. The lighting head has a first extent at a lighting output side. A transition plate has multiple connection ports through which power can pass from the lighting head to a lighting array, comprising one or more lighting modules. The lighting array has a second extent that is greater than the first extent of the lighting head. The lighting head includes an electrically conductive coupling which will allow the transition plate to be rotated relative to the lighting head, through at least one revolution, while maintaining a continuous electrical path between the lighting head and lighting array when a particular lighting array is coupled to the transition plate and the transition plate is coupled to the lighting head.

28 Claims, 35 Drawing Sheets

(56) References Cited

U.S. PATENT DOCUMENTS

| | | | | |
|---|---|---|---|---|
| 2015/0016106 | A1* | 1/2015 | Belliveau | F21V 14/02 362/233 |
| 2016/0356439 | A1* | 12/2016 | Inskeep | F21L 4/08 |
| 2017/0074489 | A1* | 3/2017 | Jurik | F21S 10/007 |
| 2019/0041048 | A1* | 2/2019 | Martin | A01G 9/249 |

OTHER PUBLICATIONS

Elation Professional, EPV762 MH User Manual (pre-2019).

* cited by examiner

FIG. 7
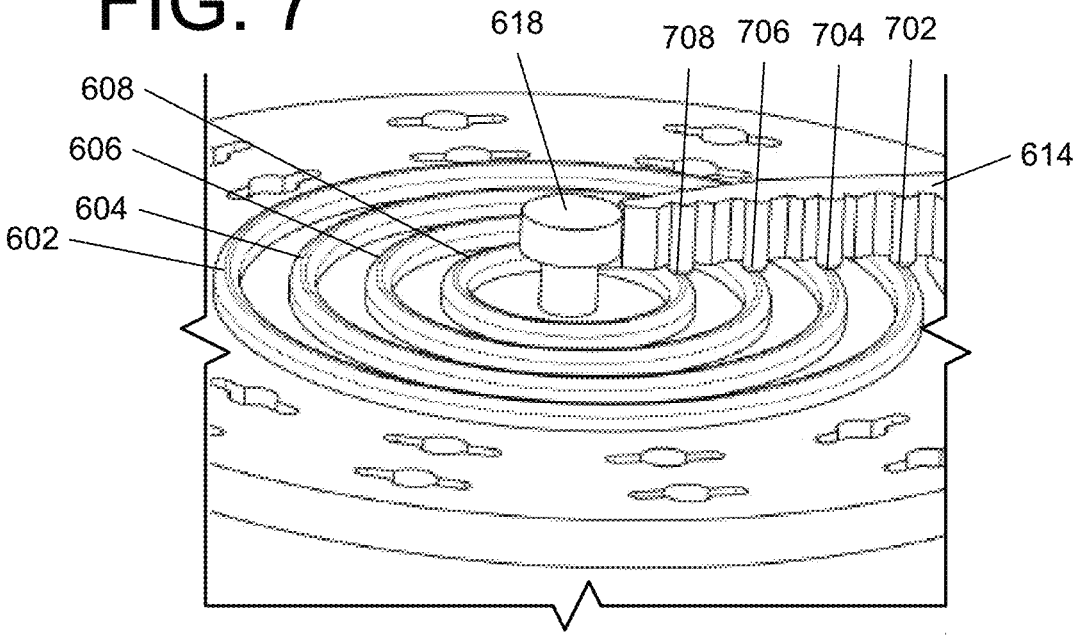
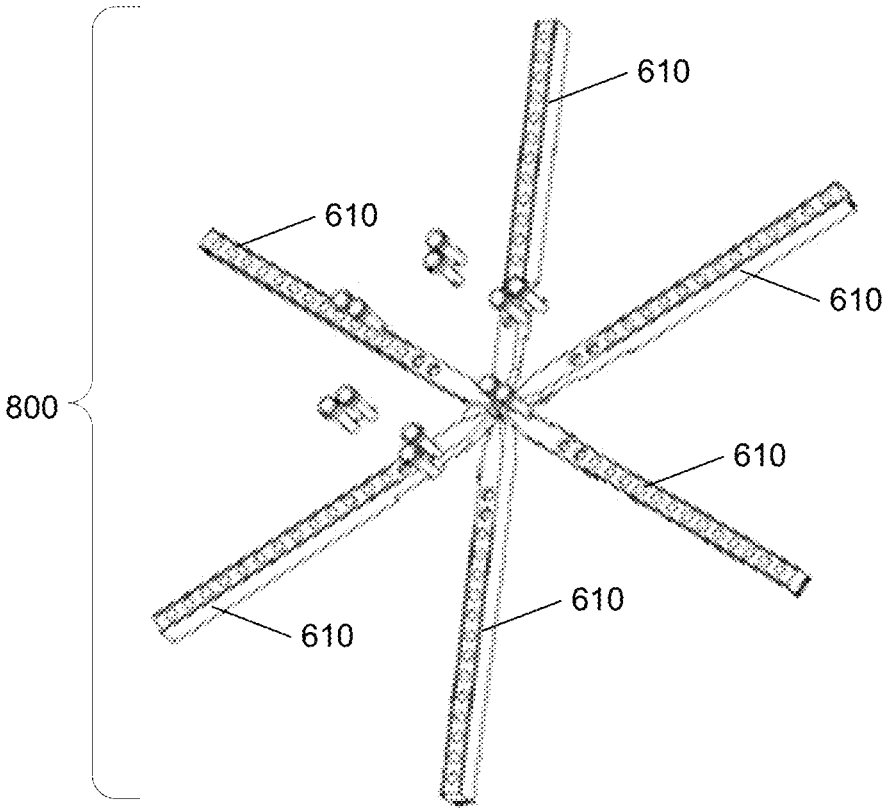
FIG. 8

FIG. 32
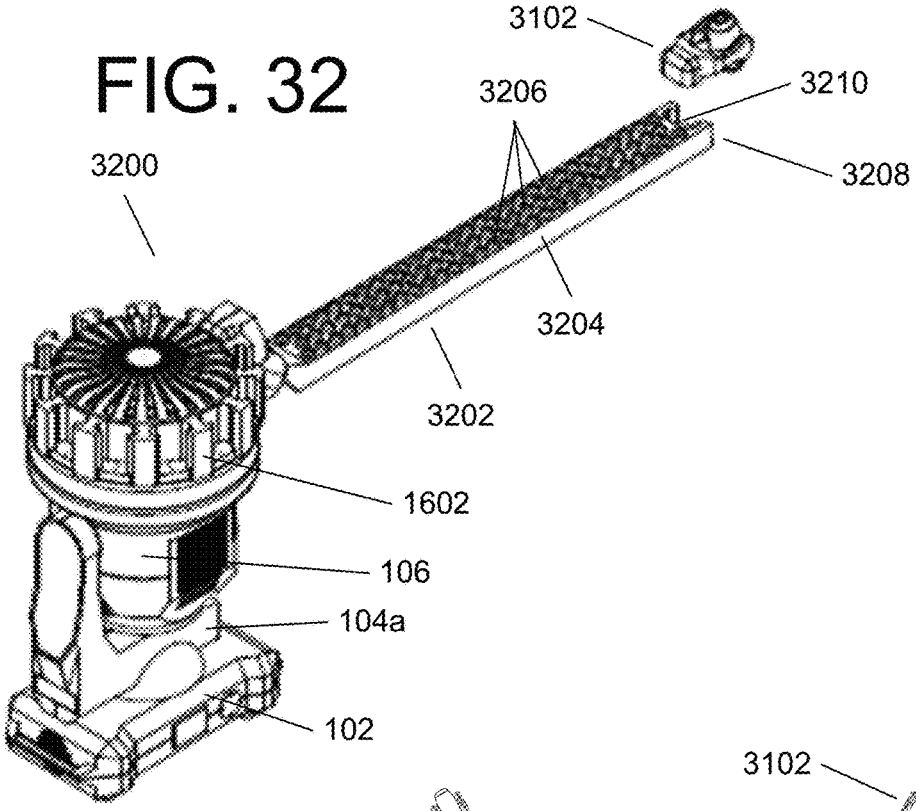
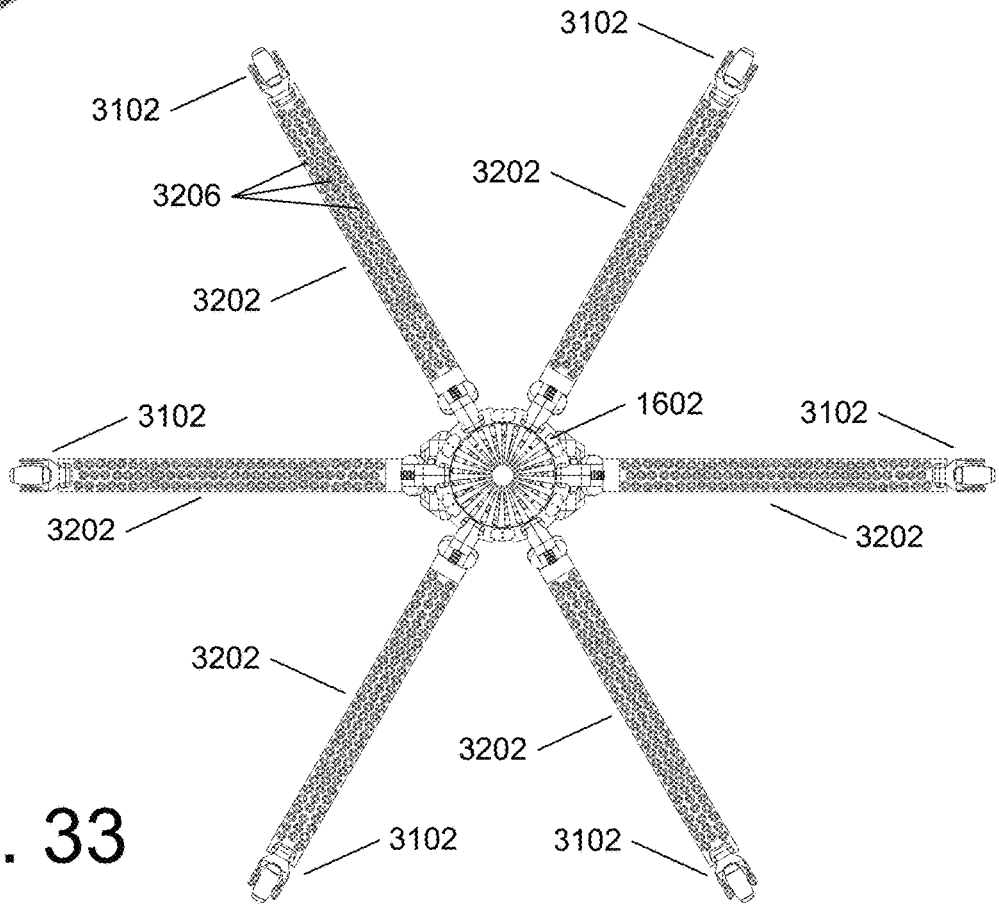
FIG. 33

MODULAR CONTROLLABLE LIGHTING FIXTURES

FIELD OF THE INVENTION

This disclosure relates generally to lighting and, more particularly, to lighting equipment.

BACKGROUND

Lighting and light shows are often used in different commercial and non-commercial venues to create, augment, or enhance the mood at an event or venue, such as for live events, television shows, concerts, plays, amusement park lighting, product launches, trade shows, experiential events, public-facing presentations, and the like. In order to do so, moving light fixtures, also referred to a automated lighting fixtures, are often used and, depending upon the specific event and lighting type desired, different size, types, forms or formats of lighting fixtures may be required.

In many cases, the lighting involved is not venue specific and permanently installed at the venue. Rather, the lighting is more commonly transported to a particular venue or location, set up for the event, and thereafter taken down and moved to a new venue for a new event or returned to a lighting rental provider. When moving to a new venue, each lighting fixture must be carefully packed or installed in a portable truss structure or array to transport while preventing damage during travel. Moreover, given the diverse lighting requirements that can be called for, in order to satisfy these diverse needs, a great deal of storage space, and lighting unit specific transporting cases, may be required to accommodate all the different size, types, forms or formats of lighting fixtures. Generally, the larger the lighting fixture, front lens or aperture, the more difficult they are to transport in rolling truss frames or other enclosed or partially enclosed structures.

SUMMARY

One aspect of this disclosure involves a lighting fixture including a base, at least one yoke, comprising at least one arm and a shaft, the at least one yoke being coupled to the base via the shaft, and controllably, rotatably, moveable relative to the base via at least a first motor. The lighting fixture further includes a lighting head coupled to the at least one yoke, wherein the lighting head is controllably rotatably movable, relative to the at least one arm of the at least one yoke, via at least a second motor. The lighting head has a first extent at a lighting output side. The lighting fixture also includes a transition plate having multiple connection ports through which power can pass from the lighting head to a lighting array. The lighting array includes one or more lighting modules and has a second extent that is greater than the first extent of the lighting head. The lighting also head includes an electrically conductive coupling which will allow the transition plate to be rotated relative to the lighting head, through at least one revolution, while maintaining a continuous electrical path between the lighting head and lighting array when a particular lighting array is coupled to the transition plate and the transition plate is coupled to the lighting head.

Another aspect involves a transition plate for coupling to a lighting head of a lighting fixture. The transition plate includes a first surface, dimensioned for coupling to a lighting head of a lighting fixture, a second surface, dimensioned and shaped with at least two connection locations so as to allow at least one lighting module to be removably physically and electrically coupled to the transition plate at either of the at least two connection locations. The first surface includes at least one electrical contact element that will allow for electrical power to be uninterruptedly transferred from a contact on the lighting head to at least one lighting array, when the at least one lighting array is coupled to the transition plate and is controllably rotated, relative to the lighting head, through multiple revolutions.

The advantages and features described herein are a few of the many advantages and features available from the representative examples presented herein and are presented only to assist in understanding the invention. It should be understood that they are not to be considered as limitations on the scope defined by the claims, or limitations on equivalents to any part of the claims. For instance, some of the advantages or aspects described herein are mutually contradictory, in that they cannot be simultaneously present in a single implementation. Similarly, some advantages may be applicable to one described aspect, and inapplicable to others. Thus, features and advantages described should not be considered dispositive in determining equivalence. Additional features and advantages arising from the teachings herein will become apparent from the following description, from the drawings, and/or from the claims.

BRIEF DESCRIPTION OF THE DRAWINGS

This disclosure is further described in the detailed description that follows, with reference to the drawings, in which:

FIG. 7 illustrates a partial cutaway view of a portion of the fixture and lighting module sub unit of FIG. 6 after the two have been coupled together;

FIG. 8 illustrates, in simplified form, an example lighting module made up of six of the sub units of FIG. 6;

FIG. 32 illustrates, in simplified form, a lighting fixture that shares the same basic components base, single arm yoke, lighting head, and transition plate as in some of the previous fixtures, to which has been coupled a lighting module in the form of an arm having three linear rows of lighting elements;

FIG. 33 illustrates, in simplified form, a top view of an example of a compound lighting module made up of the transition plate and six complex lighting modules made up of pairs of the individual lighting modules of FIGS. 32 and 31;

DETAILED DESCRIPTION

With lighting fixtures, particularly those utilized to enhance performances, live events, television shows, concerts, plays, amusement park lighting and the like, innovation is key. Among users of such lighting fixtures, once something new and improved comes out, those in the industry race to both acquire the newest technology and often sell off older equipment to: fund the purchase of the newest technology, free up storage space, or simply to keep only the most current technology on hand. New lighting fixtures come out all year long and it is extremely cost prohibitive to try and keep up by purchasing newer, costly, lighting fixtures only to find that, shortly thereafter, a better or different fixture comes out that becomes more popular than what was purchased. It is difficult even for the largest of rental companies to keep up with the ongoing evolution of lighting fixtures before their existing fixtures are even paid for. Thus, if a new lighting fixture is introduced that would produce certain special/customized lighting effects that their current lighting could not do there is no choice but to purchase an entirely new lighting fixture.

In contrast, with modular controllable lighting fixtures based upon the teachings described herein, changing to a new form of lighting or adding new special/customized lighting effects is easy and does not require replacing an entire lighting fixture, since the basic assembly is maintained and only the new lighting elements need be added. In addition, unlike conventional automated lighting fixtures, the modular nature of controllable lighting fixtures constructed based upon the teachings described herein allows for more compact storage for transporting purposes.

As used herein, the term "yoke" is intended to have its conventional configuration of two arms but is also intended to be construed to include a single arm or support, offset from its shaft or another yoke to which it is connected.

Figure 1:
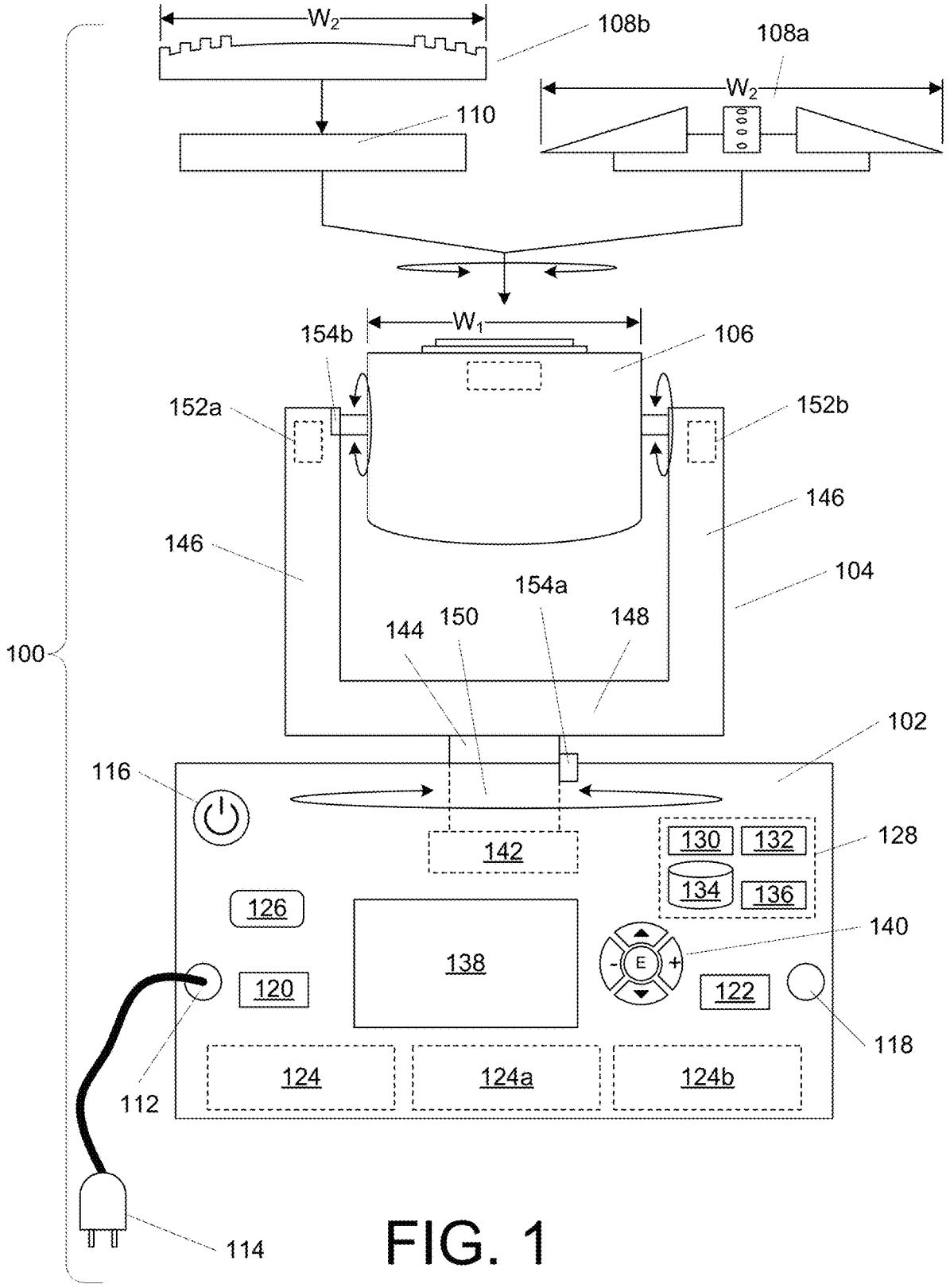
FIG. 1 illustrates, in simplified form, a generic representation of modular controllable lighting fixture according to the teachings herein.

Turning now to the figures, FIG. 1 illustrates, in simplified form, a generic representation of modular controllable lighting fixture 100 according to the teachings herein.

The modular controllable lighting fixture 100 is generally made up of a base 102, at least one yoke 104 and a lighting head 106. As will be described in greater detail below, the lighting head 106 is constructed so that any of multiple alternative lighting modules 108*a*, 108*b* can be coupled to the lighting head 106 either directly (as with the lighting module 108*a*) or indirectly via a transition plate 110.

The base 102 houses various components involved in powering and control of the modular controllable lighting fixture 100. Depending upon the particular implementation, a given modular controllable lighting fixture constructed according the teachings herein will have at least some of the following aspects, but need not have them all. Those aspects include, but are not limited to, a power input connector 112 via which power can be received via a plug 114 or another modular controllable lighting fixture (e.g., through "daisy chaining" of two or more lighting fixtures), a power on/off button or switch 116, a power out connector 118 via which power can be provided to another lighting fixture (not shown) through "daisy chaining" them together. Depending upon the particular implementation, input power can be obtained from a conventional single phase 110/115 or 220/250 volt outlet, 3 phase outlet, or analogous outlets if configured for use outside the United States.

The base 102 of the modular controllable lighting fixture 100 also may include a data input 120 connector via which program and/or control data can be provided to the modular controllable lighting fixture 100, and a data output 122 connector via which the modular controllable lighting fixture 100 can provide data to another modular controllable lighting fixture or an external control computer, or data can be read from this modular controllable lighting fixture 100. Additionally, or alternatively, data input 120 and data output 122 can be handled via a wireless controller and appropriately placed wireless receivers such that a wired connection is unnecessary. In addition, with some variants, power on/off for the modular controllable lighting fixture 100 can be handled via the wired or wireless data connection such that a power button or switch is redundant or unnecessary. Likewise, additionally or alternatively, the wireless controller can be used to send data and/or control signals to a lighting array (or one or more of its sub components) so that the need for data or control wiring within the fixture 100 for controlling display by the lighting array is reduced and/or eliminated.

The base 102 further typically includes at least one power supply 124 (typically a switching power supply), typically up to a 2000 Watt power supply rated for up to 20 amp current draws. In addition, the base 102 advantageously includes space to add one or more additional power supplies 124*a*, 124*b* so that the same lighting head 106 can be used with higher power drawing lighting modules without the need to purchase an entirely new fixture. Optionally, the base 102 can further include a direct current (DC) input receptacle 126 via which an additional portable or permanent DC power supply can be connected to provide additional power if needed for the specific configuration. To potentially accommodate later use of high powered lighting array components and/or assemblies, at manufacture the lighting fixture can be internally wired with wiring of sufficient gauge to accommodate that higher power draw so that the base and/or yoke need not be rewired or discarded. In some implementations, power supplies that convert alternating current (AC) to DC may be omitted if DC power can be supplied directly to the base 102 for lighting arrays that only require DC.

The base of the modular controllable lighting fixture 100 may also include an internal microcomputer/microcontroller/motherboard 128 made up of, for example, one or more processors 130, memory 132, non-transitory storage 134 and I/O 136. The microcomputer/microcontroller/motherboard 128 can be used, for example, to program complex lighting effects "on the fly" or to run pre-programmed lighting effects directly, or based upon data received by the modular controllable lighting fixture 100. This may involve, for example, incorporating an implementation in accordance with the Remote Device Management (RDM) and/or Architecture for Control Networks (ACN) standards. RDM is a protocol that allows for bi-directional communication between a lighting system controller or other computer-based system controller and attached RDM compliant devices over a standard digital multiplex (DMX) line to allow configuration, status monitoring, and management of implementing devices, at present, according to the "ANSI E1.20-2010, Remote Device Management Over DMX512 Networks" standard. Architecture for Control Networks (ACN) is a suite of network protocols for control of entertainment technology equipment, particularly as used in live performance or large-scale installations, for example, lighting, audio or special effects equipment, at present, according to the "ANSI E1.17-2010, Entertainment Technology—Architecture for Control Networks" standard. ACN runs over most IP transports including Ethernet and Wi-Fi (802.11) networks as well as optical fiber and/or coaxial cabling.

The base 102 may also include a display 138 via which information about the operation or programming of the modular controllable lighting fixture 100 can be viewed, for example, the "starting address" of the fixture 100 and/or the channel the fixture 100 is running on. The display may also be used to display other information such as data flow to/through the fixture 100, power consumption and/or current draw (which, due to the interchangeability of different lighting modules and ability to add one or more additional power suppl(y/ies), can provide important information, hours of operation or other measurements). The display 138 can also be used to input information, for example, if it incorporates a touch screen. Additionally, or alternatively, any other appropriate form of input (e.g., keyboard. touch pad, joystick, etc.) can be provided, along with other auxiliary or ancillary connectors, for example, a USB or other receptacle to connect another device (e.g., a phone or other unit to perform programming, upgrade software or run diagnostics). As shown, the input 140 is a type of toggle input found on may remote control hand units.

Internally, the base 102 also typically includes one or more servo or stepper motors 142 that are used to rotate the yoke 104 through some arc which, depending upon the particular implementation, can be any arc up to a full 360 degrees or more.

Finally, the base 102 will typically include one or more heat sinks and/or conventional fans (not shown), and associated fenestrations/venting, to transfer heat from the internal components out of the base 102.

A yoke 104 of the lighting fixture 100 is made up of a shaft 144, at least one, but more typically two, arm(s) 146, and a crossbar 148 that couples the shaft 144 to the arms 146. As alluded to above, a portion 150 of the shaft 144 is coupled to the one or more servo or stepper motors 142 in a conventional manner, for example, by one or more gears, linkages, belts, chains, etc. to controllably, and accurately, rotate the yoke 104 to specific and/or random positions.

Alternatively, in some implementations, the servo or stepper motors 142 can be contained within the yoke 104 instead of being within the base 102.

In addition, the yoke 104 arms 146 may contain at least one, and more likely two, servo or stepper motors 152*a*, 152*b* that are coupled to the lighting head 106 (again, conventionally, via, for example, by one or more gears, linkages, belts, chains, etc.) to enable the lighting head 106 to be controllably moved through an arc, typically of at least 270 degrees, but which could be in the vicinity of 330 degrees and, in some less common cases, 360 degrees. Alternatively, the at least one, and more likely two, servo or stepper motors 152*a*, 152*b* that are coupled to the lighting head 106, can be located within the lighting head 106. In general, the angle range for movement is not limited as a technical matter, but rather is more a function of the size of the base 102 and the fact that, beyond a certain amount of arc in either direction, the projected light will be blocked by the base 102 or a particular lighting module will contact some other part of the fixture 100 or the component (e.g., truss, wall, ceiling, support, frame, beam, gantry, etc.) to which the fixture 100 is mounted.

Figure 2:
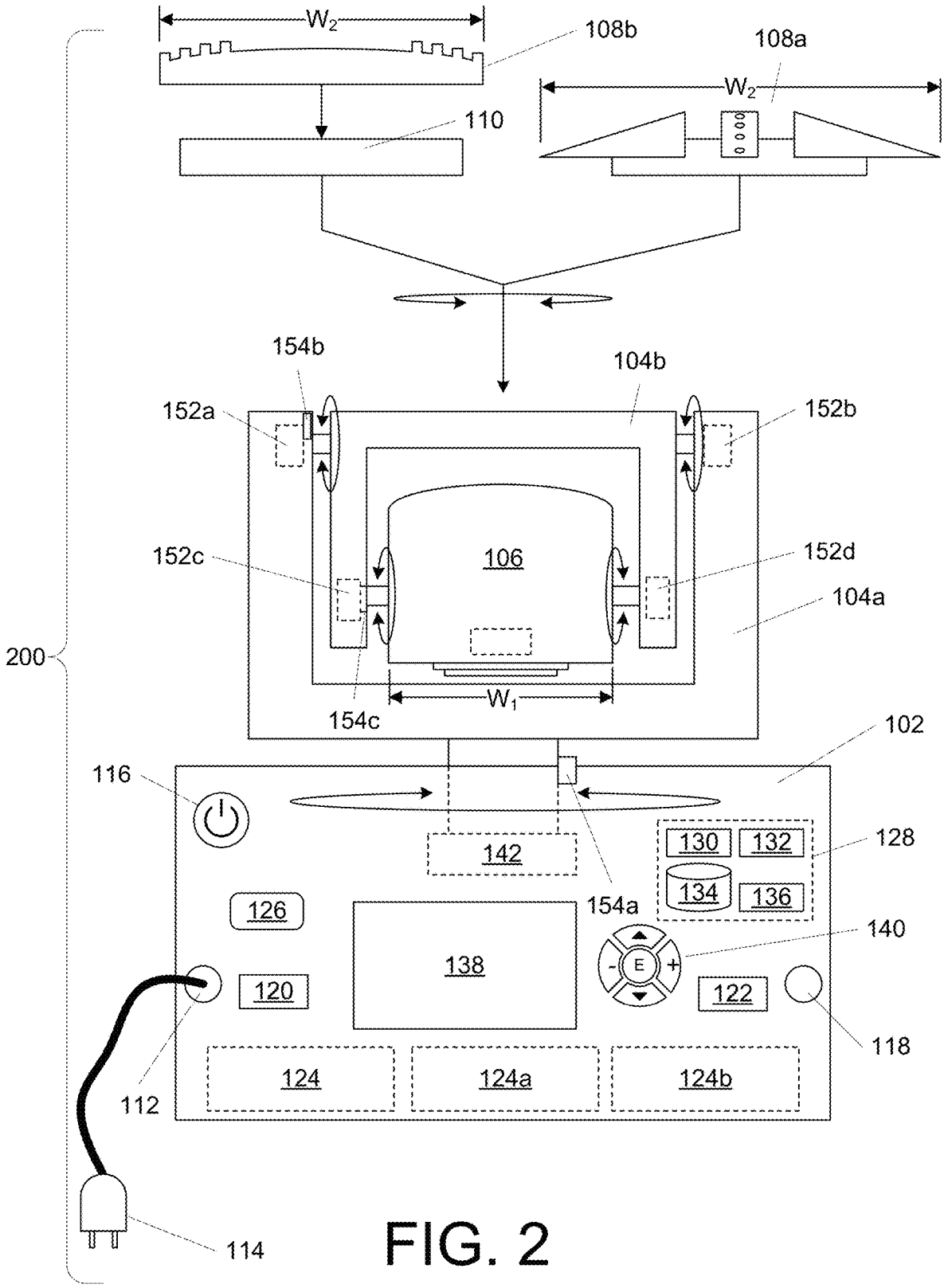
FIG. 2 illustrates, in simplified form, an alternative generic representation of modular controllable lighting fixture according to the teachings herein.

Optionally, the yoke 104 may also include one or more locking mechanisms 154*a*, 154*b*. The locking mechanisms 154*a*, 154*b* each are a type of latch that will, for example, lock the yoke 104 in place (mechanism 154*a*) relative to the base 102 and/or lock the lighting head 106 in place (mechanism 154*b*) relative to the yoke 104, to prevent movement (and potential damage) of some part of the fixture 100 during handling, packing, unpacking or transport. FIG. 2 illustrates, in simplified form, an alternative generic representation of modular controllable lighting fixture 200 according to the teachings herein. The lighting fixture 200 of FIG. 2 is similar to the lighting fixture of FIG. 1 except that it has two yokes 104*a*, 104*b*, one of which is connected to the base 102 as in FIG. 1. However, unlike the fixture 100 of FIG. 1, the first yoke 104*a* is coupled to the lighting head 106 via a second yoke 104*b*. In addition, in this configuration, the at least one, and more likely two, servo or stepper motors 152*a*, 152*b* are coupled to the second yoke 104*b* (again, conventionally, via, for example, by one or more gears, linkages, belts, chains, etc.) to enable the second yoke 104*b* to be controllably moved through an arc of, typically, up to 360 degrees. Likewise, the second yoke 104*b* includes at least one, and more likely two, servo or stepper motors 152*c*, 152*d* that are coupled to the lighting head 106 (again, conventionally, via, for example, by one or more gears, linkages, belts, chains, etc.) to enable the lighting head 106 to be controllably moved through an arc as described in connection with FIG. 1. Alternatively, the second yoke 104*b* can be connected to the first yoke 104*a* via a motor driven drive shaft. Similarly, locking mechanisms 154*a*, 154*b*, 154*c* can be provided to lock the yokes 104*a*, 104*b* in place during handling, packing, unpacking or transport. Advantageously, by having two yokes 104*a*, 104*b*, one within the other, as can be seen in FIG. 2, the lighting fixture 200 can be more compact when not in use, and can have a greater "reach" when in use, allowing for greater movement, and accommodation, of larger format lighting modules, which is particularly useful when the lighting array may otherwise be impeded by the structure to which it is attached or some nearby structure.

Referring now to both FIG. 1 and FIG. 2, a key advantage of lighting created according to the teachings herein is that, despite the fact that the lighting heads 106 have a given extent (width or diameter) $W_1$ measured at the lighting output side, such lighting allows for use of lighting arrays that, when coupled to the lighting head 106 have a greater overall extent $W_2$ than at least the lighting head 106 and, in many implementations, the width of the yoke arms (if two arms) or, if a single yoke arm, between a single yoke arm and its implied mirror image.

Figure 3:
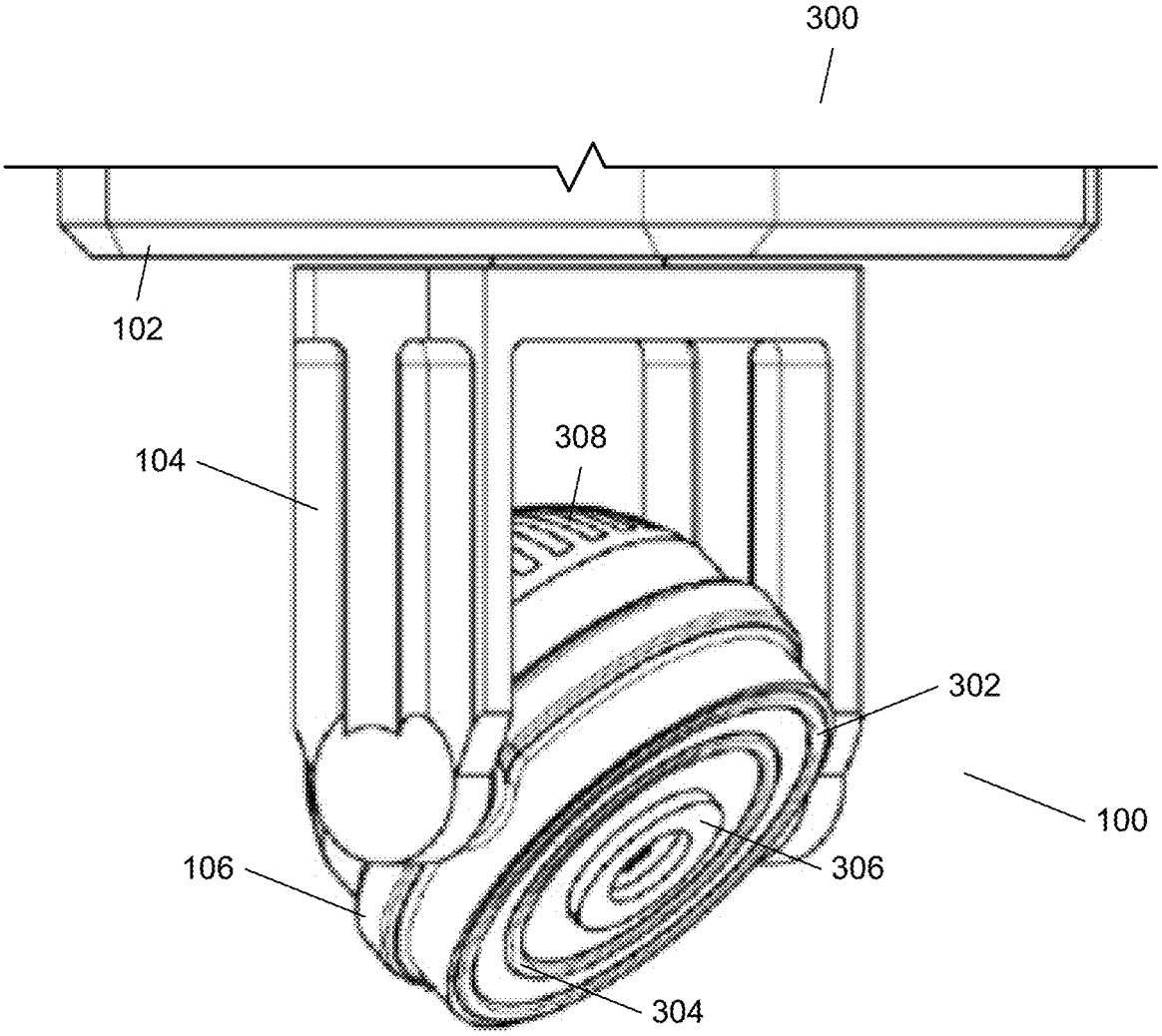
FIG. 3 illustrates, in simplified form, a portion of an example variant fixture showing a small portion of a base, and one example variant lighting head coupled to an example yoke.

FIG. 3 illustrates, in simplified form, a portion 300 of an example variant fixture 100 showing a small portion of a base 102, and one example variant lighting head 106 coupled to an example yoke 104. As shown, the lighting head 106 includes two concentric, electrically conductive rings 302, 304 via which power can be provided to one or more lighting modules (not shown), when coupled to the lighting head 106. This configuration allows a lighting array to be rotated relative to the lighting head 106 without interruption of the flow of electricity.

In addition, the lighting head 106 may also include internal lighting control circuitry and or wiring to allow for specific control of the lighting of components of a connected lighting module. As shown, the lighting head 106 of FIG. 3 also optionally includes a third ring 306, via which data signals can be provided to a connected lighting module to specify or control whether individual lights of a connected lighting module should be on or off at a given point in time, even if the lighting module (or some component(s) thereof) may moving relative to the lighting head 106 at the time. Advantageously, depending upon the particular implementation, the specific number of rings that will be present can be set to accommodate whatever power, control, and/or data is or may be used. Thus, additional rings may be provided to allow for, for example, concurrent use of different voltage levels and/or different concurrent data signals. Moreover, depending upon the particular implementation, optional controllable switching inside the lighting head, can allow for a given ring of the lighting head 106 to provide power for one type of lighting module, and by changing the switching, that same ring can be used to provide a low voltage data signal for a different type of lighting module. Still further, although the rings 302, 304, 306 are shown as being within the peripheral boundary (i.e., extent $W_1$) of the lighting head 106, any one or more of the rings 302, 304, 306 could alternatively be located at the periphery, or even on (or at some specified distance from) the outer surface of the lighting head, for example, to accommodate even larger lighting modules while maintaining electrical conductivity during rotation, or to serve as auxiliary support(s) for one or more lighting elements or modules that are not intended to rotate.

Still further, the lighting head 106 may include other conventional components, such as one or more cooling fan(s) and/or fins or heat sink(s) and, for example, ventilation fenestrations 308.

Finally, as will be discussed below, the lighting head 106 may include a coupling (not shown) on a side opposite the concentric rings, to which counterbalance weight(s) may be attached to counterbalance different lighting modules that might be coupled to the lighting head 106. This can reduce the torque applied to, and prolong the life of, the motor(s) and/or enable smoother operation of the lighting fixture 100.

Figure 4:
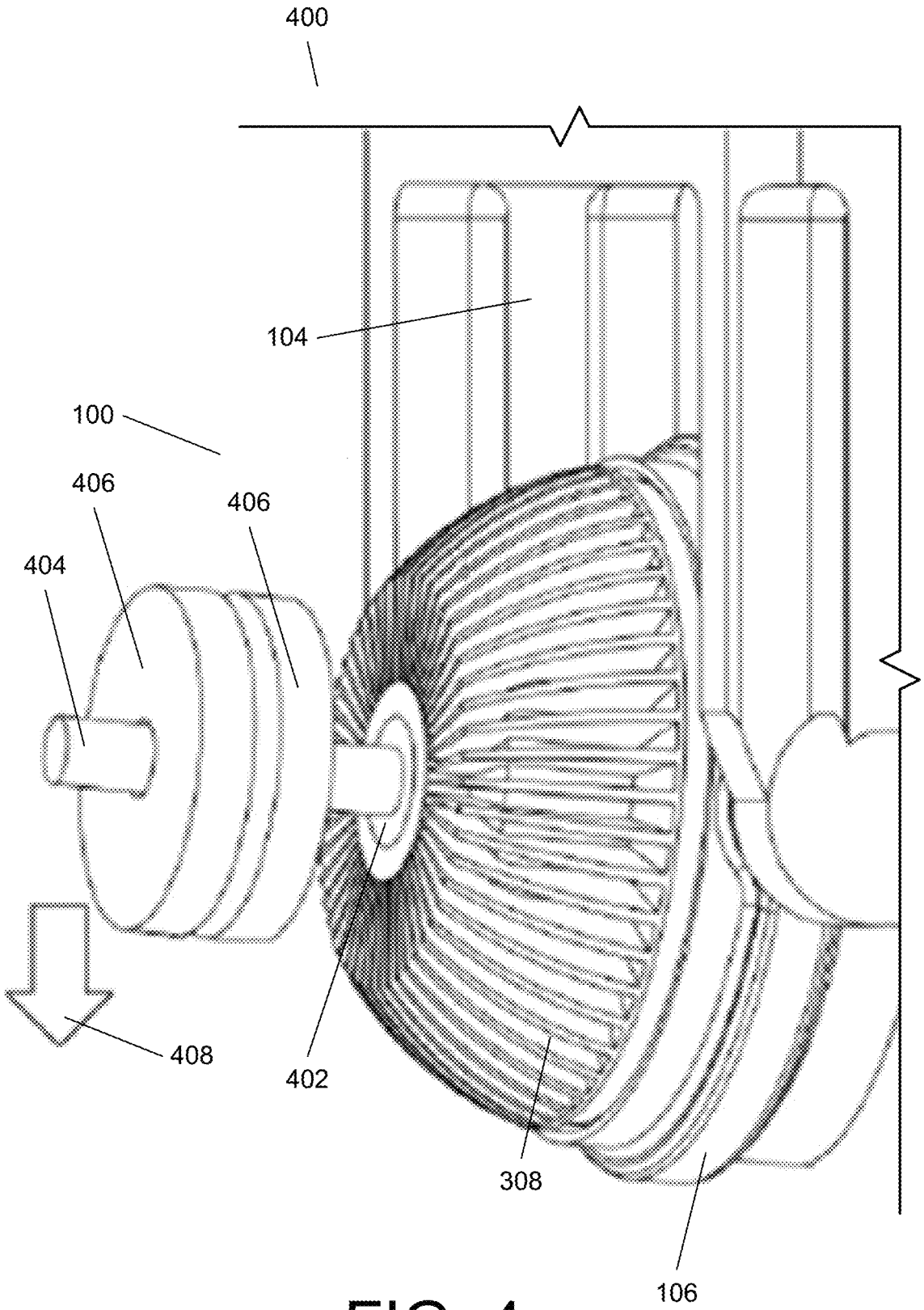
FIG. 4 illustrates, in simplified form, an alternative view of a portion of the lighting fixture of FIG. 3, more particularly, part of the side opposite the concentric rings.

FIG. 4 illustrates, in simplified form, an alternative view of a portion 400 of the lighting fixture 100 of FIG. 3, more particularly, part of the side opposite the concentric rings. As can now be seen, this side includes a coupling 402 to which a rod 404 or other element may be connected. The rod 404 or other element is shaped so as to be able to variably optionally accept one or more weights 406 to offset/counterbalance 408 (in whole or part) weight modification incurred by interchanging, or attachment of one or more, lighting modules and/or a transition plate or adapter as will be described below. As shown, the rod 404 or other element is a single straight round bar.

Figure 5:
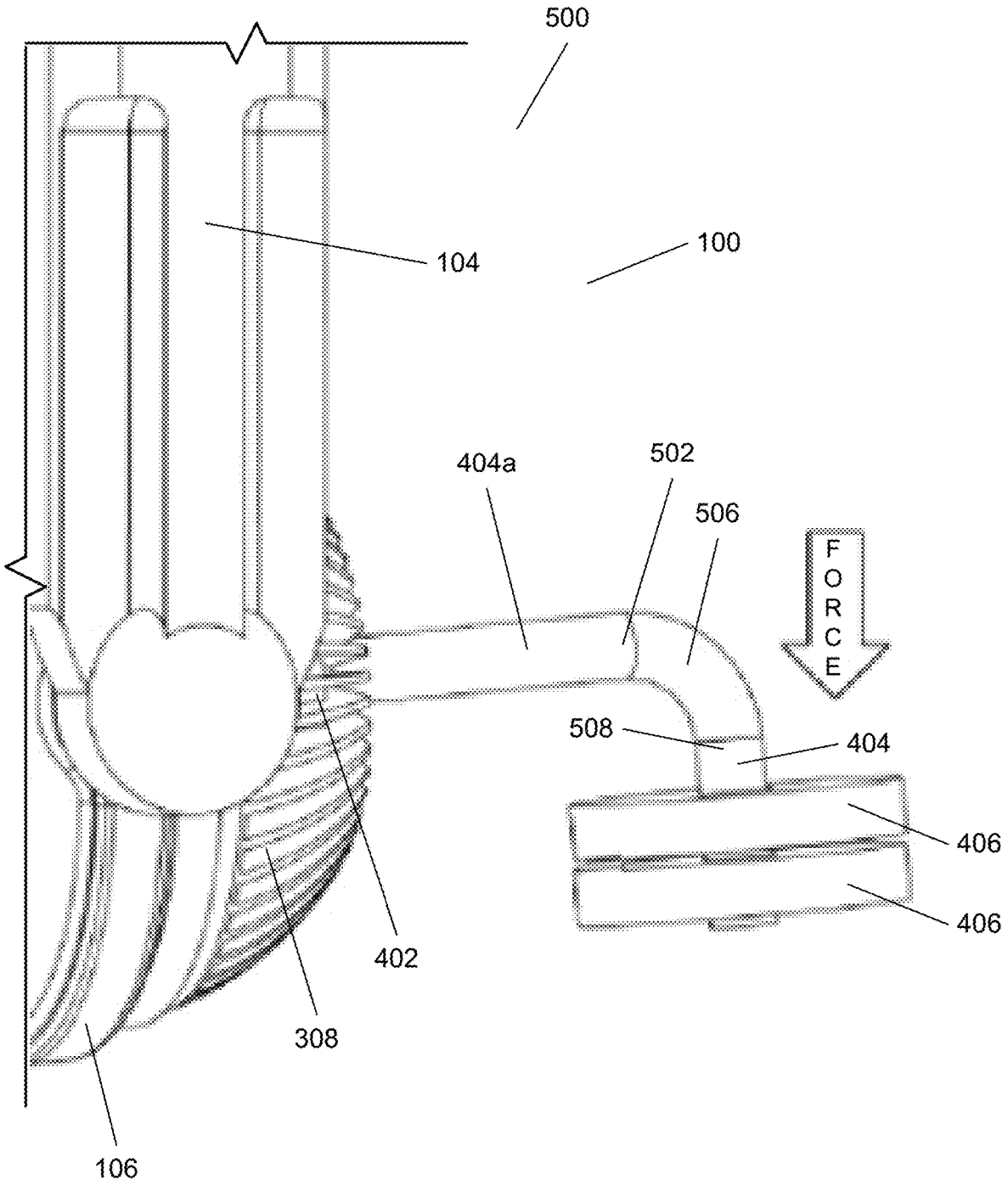
FIG. 5 illustrates, in simplified form, an other alternative view of a portion of the lighting fixture of FIG. 3.

FIG. 5 illustrates, in simplified form, an other alternative view of a portion 500 of the lighting fixture 100 of FIG. 3. As can be seen from FIG. 5, for some lighting modules, it may be impractical or undesirable to counterbalance a given lighting array by merely adding weight to the lighting fixture 100. Advantageously, with some implementations of the lighting fixtures constructed in accordance with the teachings herein, different length and/or orientations of rods or other elements can be connected to the coupling 402 so as to use the effect of a longer moment arm and less weight to offset (in whole or part) the weight of an attached lighting module and/or to make sure that a longer rod 404*a* and weights 406 do not interfere with the particular lighting modules attached to the lighting fixture 100. As shown in FIG. 5, an end 502, opposite the end 504 of the longer rod 404*a* that connects to the coupling 402, is connected to an extension joint 506 (in FIG. 5, shown as angled 90 degrees), which, in turn, is connected to an end 508 of the short rod 404. Advantageously, with different implementations, other size/length/shape extension joints (straight, curved, angled, etc.) can be used, as can different size/length/shape rods in order to provide sufficient weight offset within an acceptable amount of space and without interfering with the operation of any part of an attached lighting module.

As mentioned previously, the lighting fixture is optimally constructed so that any of multiple (2 or more) different modular light arrays (bearing in mind that different configurations of the same basic modular light array are intended to be considered different modular light arrays) can be physically and electrically coupled to a lighting head 106, as mentioned above, so as to advantageously create, in effect, different lighting fixtures and provide different lighting effects, from the same basic lighting fixture. Of course, one need only use just one removable light array with a given lighting fixture 100, although, obviously, some advantages will be sacrificed.

In simplified overview, a lighting module, as that term is used herein, is made up of multiple lighting sub units that can individually be coupled to/decoupled from a lighting head 106. Each of the multiple lighting sub units is made up of at least one lighting element (e.g., a light bulb (e.g., incandescent, halogen, fluorescent, high intensity discharge, etc.), a light emitting diode (LED), a laser diode, etc.) or an OLED or other display), a supporting structure, and any appropriate electrical and/or data path(s) needed to so that power (and/or data) can get from the lighting head 106 to the particular lighting element(s). A lighting module can also be or include a video display. Optionally, a lighting module can further include some structure(s) for cooling the lighting elements (e.g., ventilation fenestrations, fins, heat sink(s), a fan, etc.). Depending upon the particular implementation, the lighting elements can be placed anywhere on the lighting module (i.e., on a single surface or on multiple surfaces).

Figure 6:
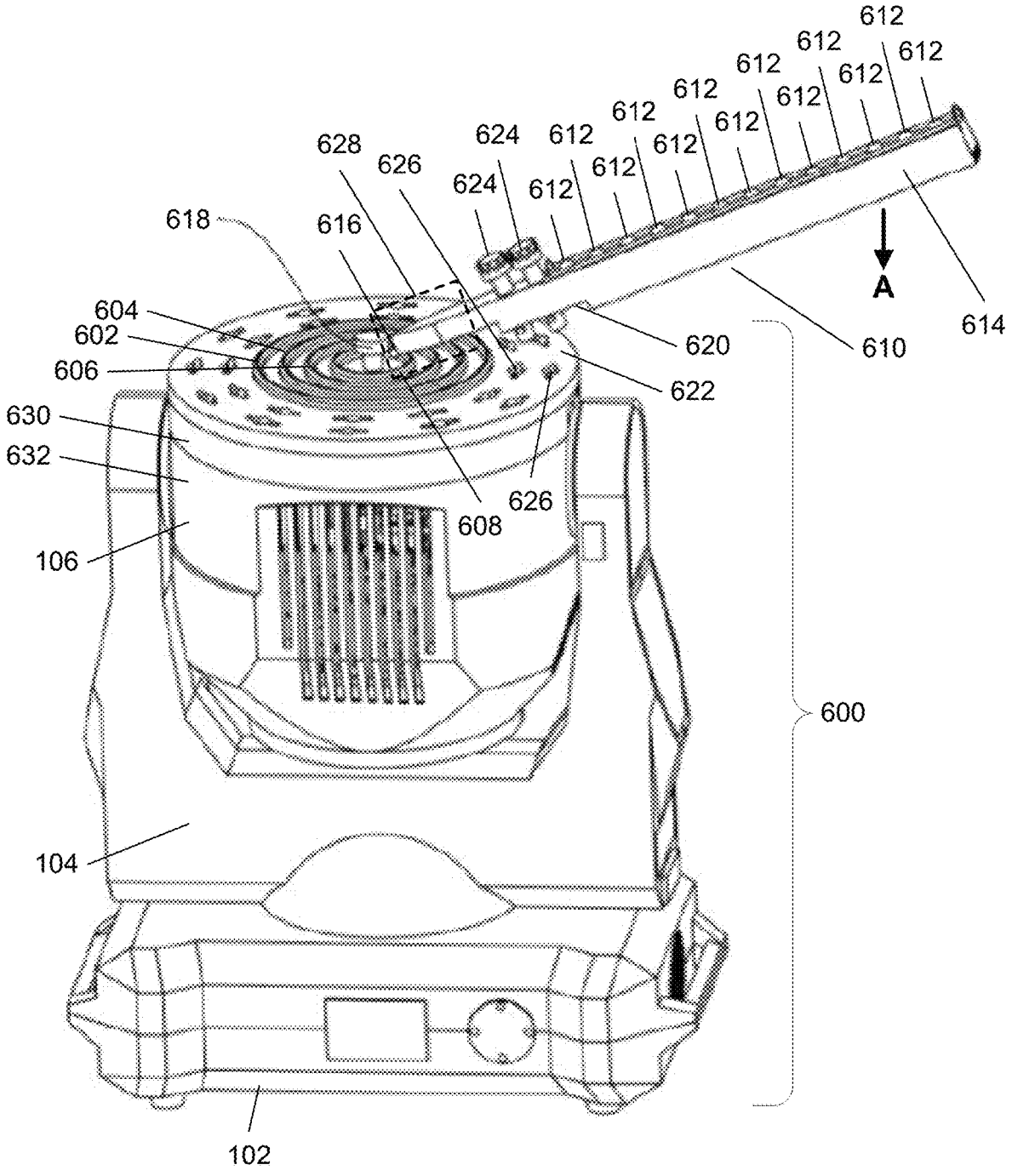
FIG. 6 illustrates, in simplified form, another example lighting fixture according to the teachings herein.

FIG. 6 illustrates, in simplified form, another example lighting fixture 600 according to the teachings herein. As shown, the lighting head 106 includes four concentric connection rings 602, 604, 606, 608 through which, in this example, power and data can be transferred to a sub unit 610 of a lighting module. The sub unit 610 is made up of multiple lighting elements 612 and an associated supporting structure 614. As shown in FIG. 6, the supporting structure 614 physically couples to the lighting head 106 by hooking part of an end 616 of the supporting structure 614 under a retaining post 618 and pivoting the supporting structure in the direction of arrow "A" until a recessed surface 620 in the supporting structure 614 abuts a surface 622 of the lighting head 106, at which point, one or more locking screws 624 can engage matingly corresponding openings 626 to lock the sub unit 610 into place. Alternatively, in some implementations, other fastening elements, for example, magnets, clips, etc. can be used in addition to, or in place of, locking screws.

At this point it is worth noting that some variants can be constructed such that one portion 630 of the lighting head 106 is rotatable relative to another portion 632 of the lighting head, in order to allow the sub unit(s) 610 to rotate relative to that "fixed" portion 632. In such a case, even if the two portions 630, 632 are part of the lighting head, the rotateable portion 630 is deemed to be a transition plate as will be described below.

FIG. 7 illustrates a partial cutaway view of a portion (628 of FIG. 6) of the fixture 600 and lighting module sub unit 610 of FIG. 6 after the two have been coupled together. As can be seen in the cutaway of FIG. 7, the supporting structure 614 includes conductive contacts 702, 704, 706, 708 that correspond to, and form a conductive path with, the rings 602, 604, 606, 608 to allow for, in this case, power 602, 608, 702, 708 and data, 604, 606, 704, 706 to pass between the lighting head 106 of FIG. 6. and the sub unit 610.

FIG. 8 illustrates, in simplified form, an example lighting module 800, in this example, made up of six of the sub units 610 of FIG. 6. It should now be appreciated that, based upon the opening 626 in the surface 622 of the lighting head 106 of FIG. 6, advantageously, as few as one of these sub units 610 and as many as twelve of these sub units 610 could be used with the same lighting fixture 600. Thus, from even this simple fixture 600, multiple different lighting configurations and/or beam spreads, can be created, and/or effects produced, without the need to purchase an entirely new lighting fixture. Accordingly, it should be understood that, depending upon the particular transition plate design, any number of lighting modules can be used provided there is sufficient physical space for them. Still further, by creating a transition plate with multiple surfaces 622 arranged in tiers, even more lighting modules can potentially be attached than could otherwise be attached.

Now, in some cases, there may be a need or requirement for a particular lighting array that may not be directly compatible with the lighting head of the particular implementation for some reason. Advantageously, in accordance with the teachings herein, the lighting array may still be able to be accommodated through use of a removable transition plate. In simplest form, where it is not part of the lighting head merely to provide rotational capability, the transition plate is simply a device that mechanically and electrically provides two sides, one side compatible with the physical and/or electrical connections of the lighting head and the other side compatible with the physical and/or electrical connections of the particular lighting array. More complex transition plates may include additional lights, motors, gears, computer controls, mirrors, or other desirable components. Advantageously, the transition plate provides significant flexibility because, depending upon the circumstances: a) various sub units can be attached prior to transport as a pre-configured arrangement, and then the transition plate with its sub units can be attached to the lighting head on site, or b) different sub units can be transported separately and compactly, and configured on the transition plate on site. Moreover, the transition plate approach allows for the lighting fixture to be installed first, at one point in time and, at a different time thereafter, a transition plate with a particular configuration of sub units can be attached and, at a still later time, that configuration of sub units can be replaced by a new configuration of sub units without removing the lighting fixture, or a wholly different transition plate (with its associated lighting) can be substituted. Still further, the modular nature arising from the use of the transition plate allows for flat pack shipment of components and/or more compact packaging for transport.

Figure 9:
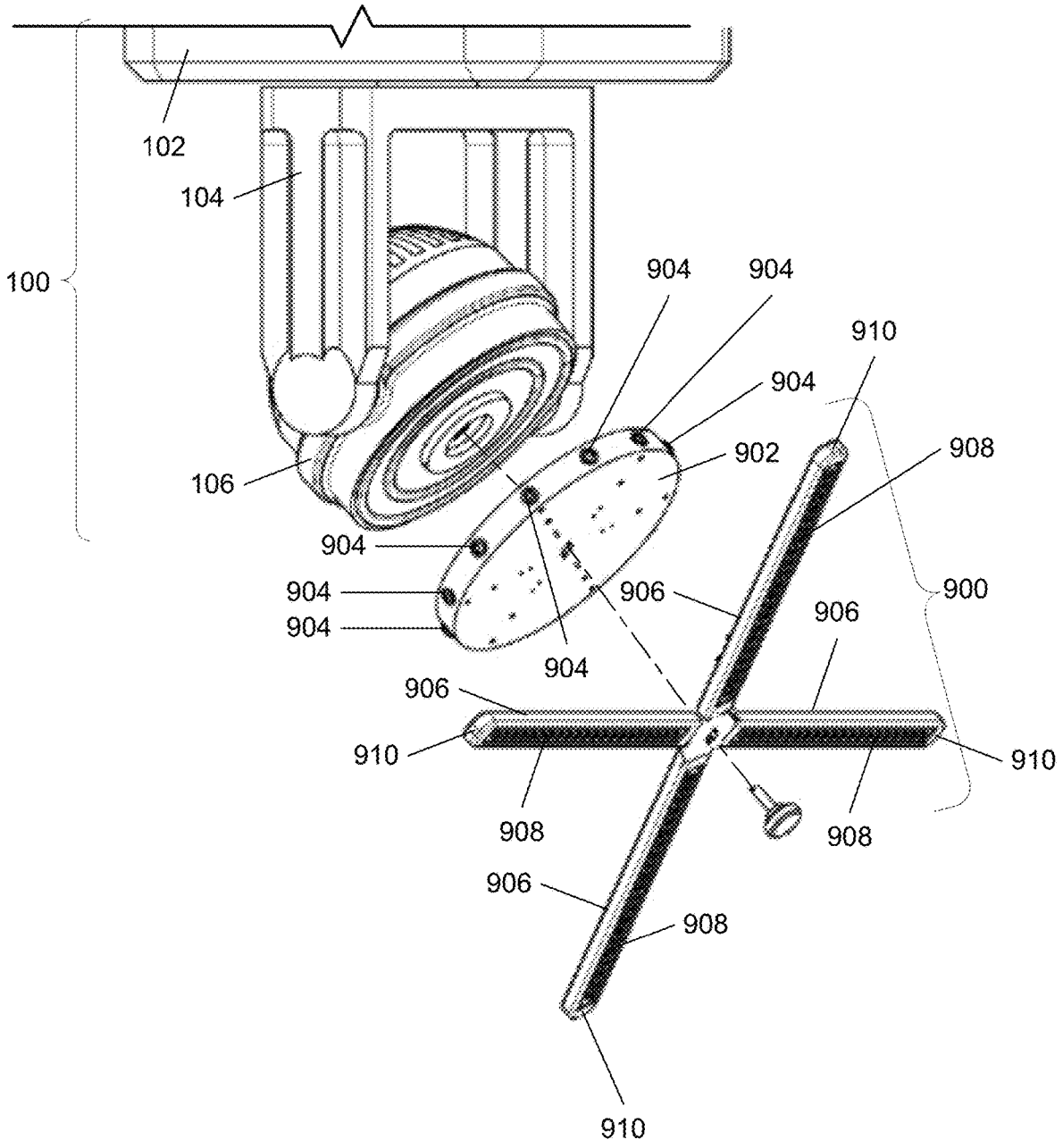
FIG. 9 illustrates, in simplified form one example of a portion of lighting fixture and lighting module that uses a transition plate to allow the lighting module to properly physically and electrically mate with the lighting head of the fixture.

FIG. 9 illustrates, in simplified form one example of a portion of lighting fixture 100 and lighting module 900 that uses a transition plate 902 to allow the lighting module 900 to properly physically and electrically mate with the lighting head 106 of the fixture 100. As shown, the transition plate 902 *f* FIG. 9 includes a series of additional lighting modules 904 about the periphery. Depending upon the particular implementation, these additional lighting modules 904 may be independently controlled (individually or as a group) independent of the lighting elements of the lighting array 900. As shown, each arm 906 of the lighting module 900 includes an arrangement of multiple lighting elements 908 longitudinally along the length of each arm 906. Likewise, depending upon the particular implementation, the lighting elements 908 may be individually controlled, or controlled in groups.

Advantageously, as noted above, each arm 906 is individually removably coupled to the transition plate 902, so that different numbers, sizes or lengths of arms 906 can be used with the same lighting head 106.

In addition, some implementations of the arms 906 can optionally include a removable end cap 910 that will expose connections (physical and/or electrical) and allows an extension arm, containing additional lighting elements, to be attached to the end of an arm 906, either longitudinally, to simply be a linear extension of the arms 906, at a fixed angle, or via a movable hinge, swivel or pivot, to allow the extension arms to be positioned at different angles relative to the arms 906. Still further, some additional variants of the arms 906 or extension arms can include a small servo or stepper motor or other mechanism (e.g., cabling) that can be used to move an extension arm during a lighting show in order to create a specific lighting effect.

Figure 10:
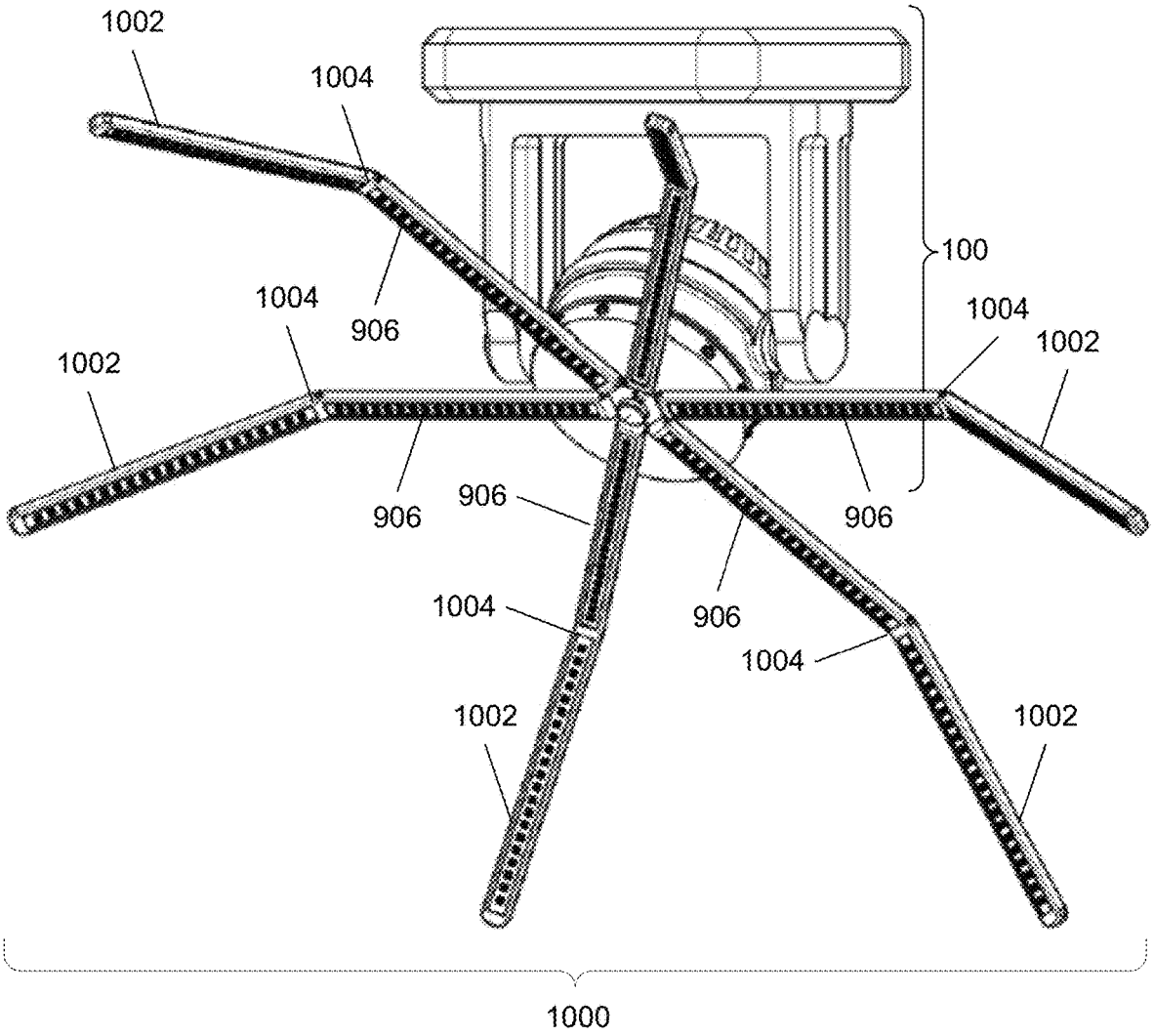
FIG. 10 illustrates, in simplified form another example of a lighting fixture to which an alternative lighting module has been coupled.

FIG. 10 illustrates, in simplified form another example of a lighting fixture 100 to which an alternative lighting module 1000 has been coupled. As shown, this lighting module 1000 includes six of the arms 906 of FIG. 9, in which the end caps have been removed and extension arms 1002 have been attached. Depending upon the particular implementation, the extension arms 1002 can be fixed in position, or can be movable during use, via, for example using a motorized a movable hinge, swivel or pivot 1004, a cam, gears, or an arrangement of one or more cables that allows the extension arms 1002 to be moved during use.

Figure 11:
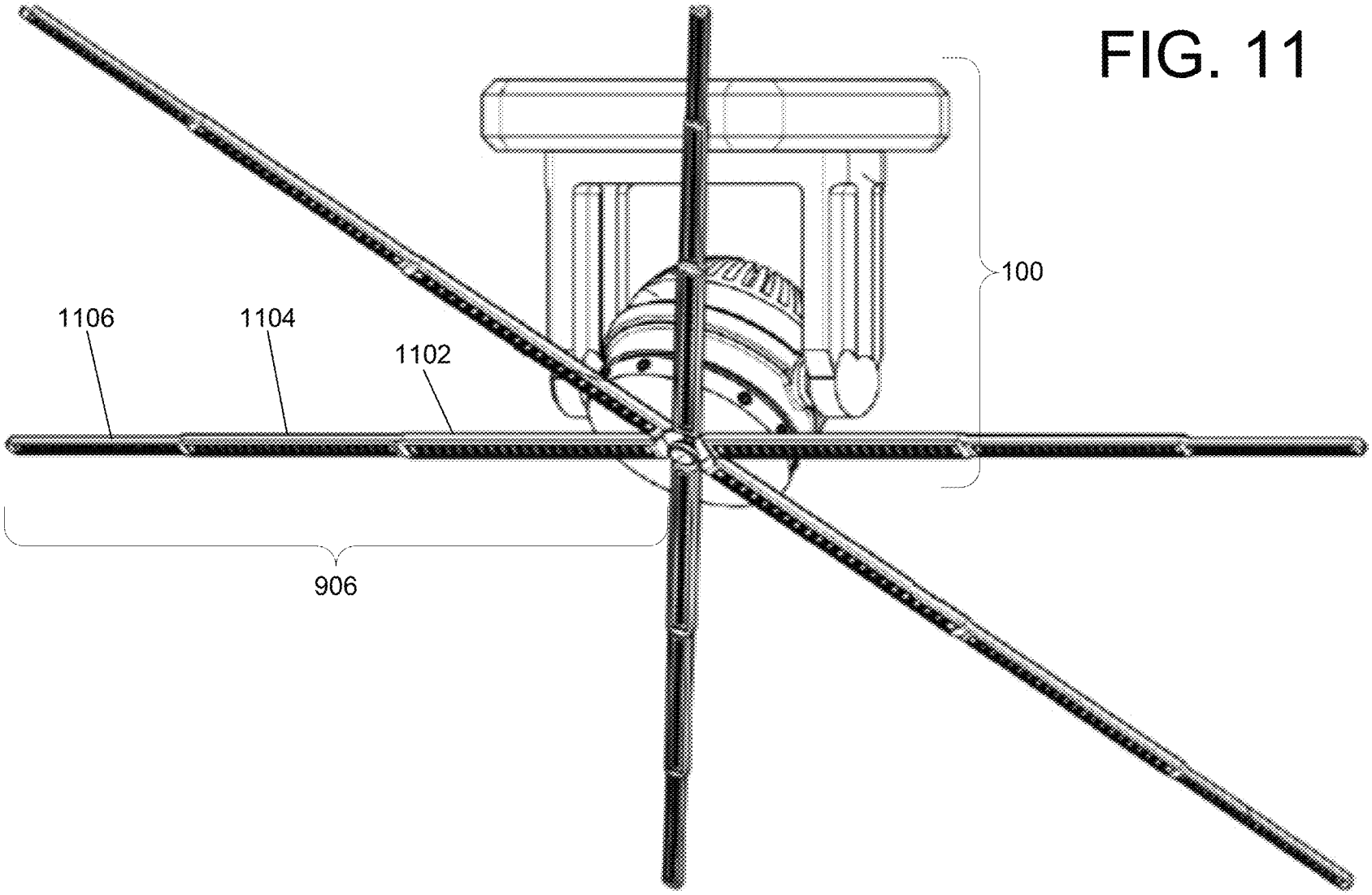
FIG. 11 illustrates, in simplified form another example of a lighting fixture to which an other alternative lighting module has been coupled.

FIG. 11 illustrates, in simplified form another example of a lighting fixture 100 to which an other alternative lighting module 1100 has been coupled. As shown, each arm 906 of this lighting array is made up of two or more (as shown, three) telescoping, lighting elements-containing, segments 1102, 1104, 1106. Again, depending upon the particular implementation, the segments may be constructed so that they can be manually extended and fixed in place, or they can be repositioned, using a small servo or stepper motor or other mechanism (e.g., cabling), during set up or when in use.

Having described some of the basic different types of configurations of lighting that can be implemented using some different example combinations of lighting fixture, transition plate, and lighting modules, it is to be appreciated that, by applying the teachings herein, much more sophisticated configurations can readily be constructed that allow for great variations in lighting capabilities, using a single lighting fixture 100.

Figure 12:
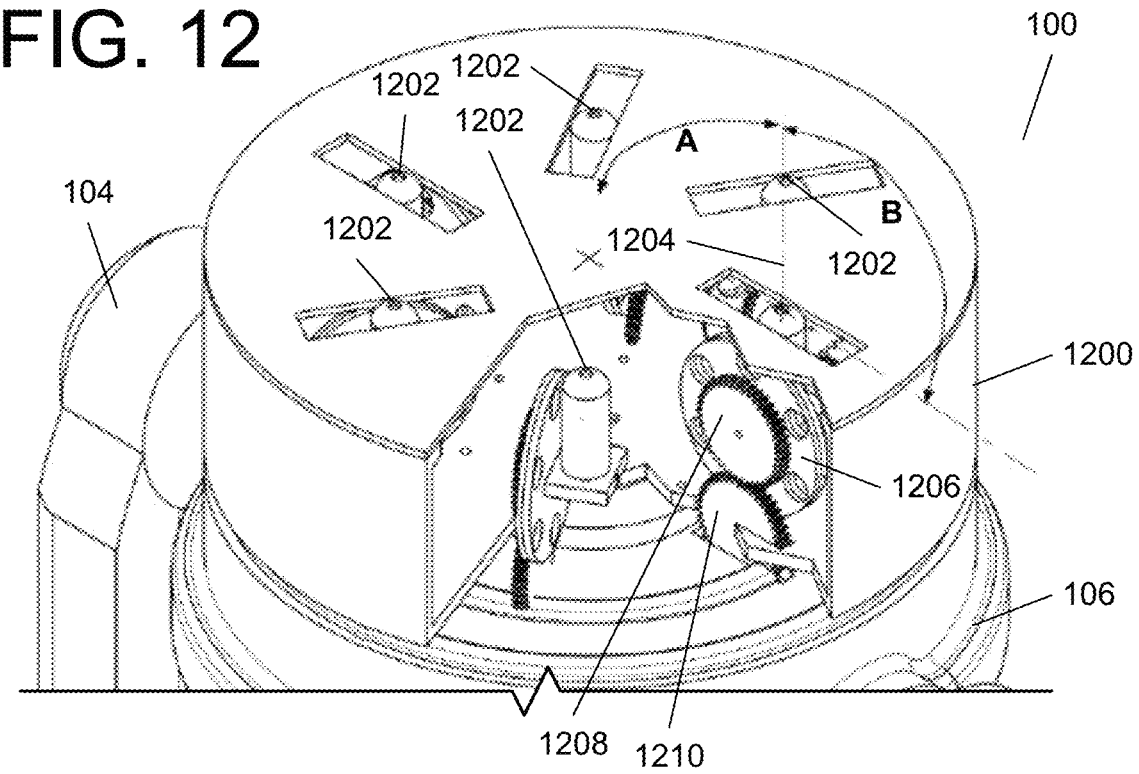
FIG. 12 illustrates, in simplified form, a partial cutaway view of a portion of a lighting fixture coupled to one alternative example of another transition plate.

In that regard, FIG. 12 illustrates, in simplified form, a partial cutaway view of a portion of a lighting fixture 100 coupled to one alternative example of another transition plate 1200 which, itself, incorporates a lighting array and can advantageously be used with a lighting fixture 100 as described herein. As a side note, it should be understood that, advantageously, in some cases, a transition plate that contains lighting elements can be used, by itself, in connection with a lighting fixture as described herein. The transition plate 1200 shown therein includes six lighting elements 1202 that can each be controllably pivoted from vertical 1204 in the directions of the arrows labeled "A" and "B". The pivoting is accomplished, in this example, by virtue of the lighting elements 1202 being connected to a retaining disk or spool 1206 using a pair of gears 1208, 1210; rotational movement of the first gear 1210 via a stepper motor or servo causing opposite rotational movement of the second gear 1208 and corresponding movement of the lighting element 1202.

Figure 13:
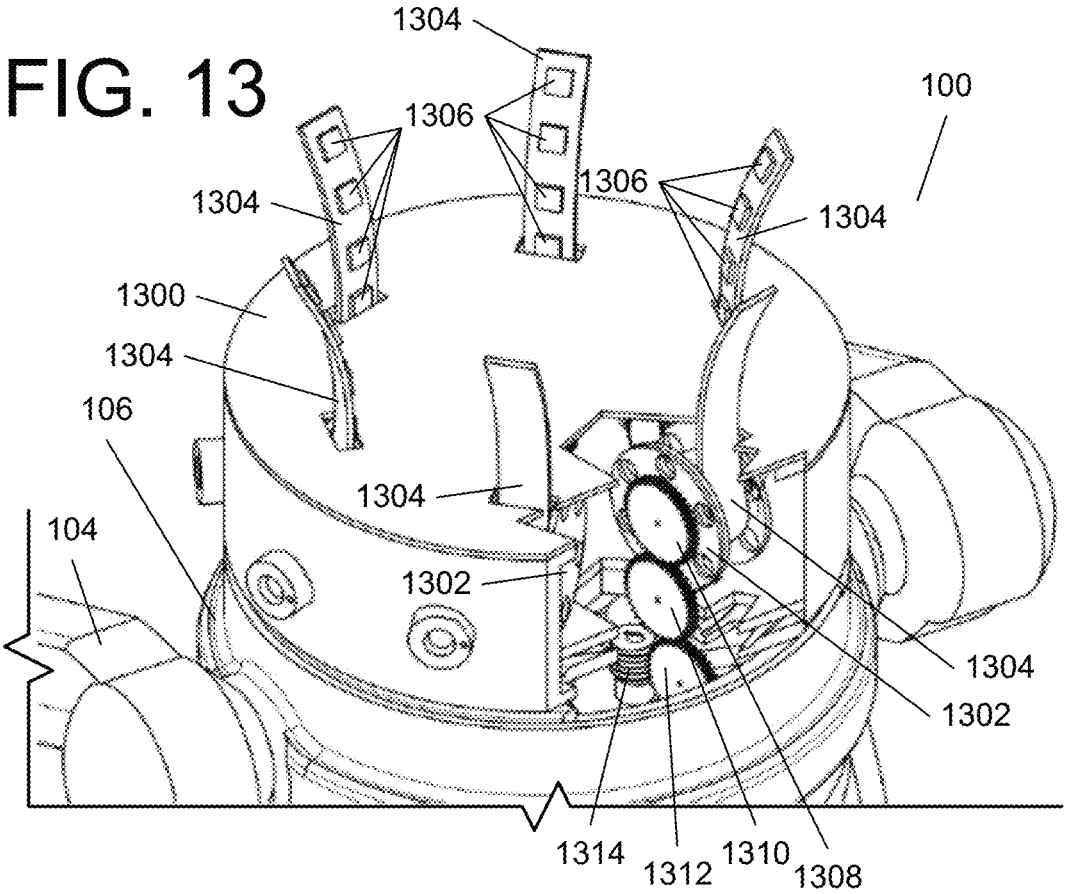
FIG. 13 illustrates, in simplified form, a partial cutaway view of a portion of another configuration lighting fixture coupled to one alternative example of yet another transition plate.

FIG. 13 illustrates, in simplified form, a partial cutaway view of a portion of another configuration lighting fixture 100, in this example, coupled to one alternative example of yet another transition plate 1300. As shown, this transition plate 1300 includes a series of spools 1302 around each of which are wrapped a lighting strip 1304 containing a set of lighting elements 1306. A gear train, in this example, made up of three gears 1308, 1310, 1312 is driven by a worm gear 1314 to cause the associated lighting strip 1304 to extend from, or retract into, the interior of the transition plate 1300. Depending upon the particular implementation, the lighting strips can actually extend into, or retract from, arms (not shown) that provide support for the lighting strips 1304. Alternatively, in use, the portion of the lighting strips that are outside the interior of the transition plate 1300 can be unsupported so that, for example, they can swing freely if the transition plate 1300 is rotated relative to the lighting head and/or if the lighting head is moved relative to the yoke(s) 104 and/or base 102.

Alternatively, with respect to FIG. 12 or FIG. 13, in lieu of gears, other elements can be used to cause light element movement, such as solenoids, linkages, guides, slides, Geneva mechanisms etc., by themselves or in combination with each other or one or more gears.

Figure 14:
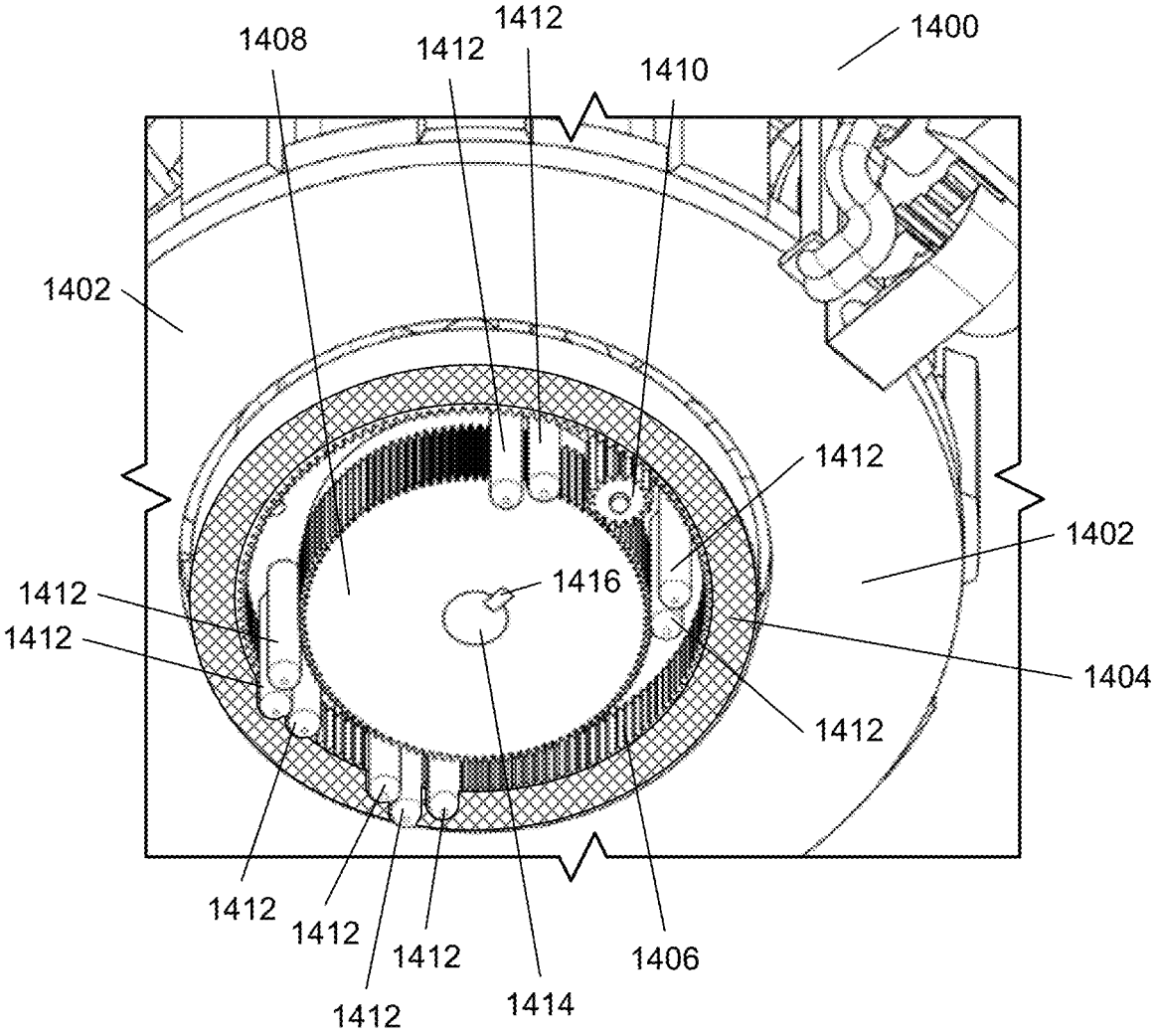
FIG. 14 shows an underside view of a portion of one example transition plate along with a cutaway portion of a lighting head.

FIG. 14 illustrates, in simplified form, an example mechanism that can be used to rotationally move a transition plate relative to a lighting head to which it is attached.

More particularly, FIG. 14 shows an underside view of a portion 1400 of one example transition plate 1402 along with a cutaway portion 1404 of a lighting head, as described herein, taken through a plane parallel to a junction between the transition plate 1400 and lighting head, with the part of the lighting head that was cut through indicated by cross-hatching. As shown, there is a ring gear 1406 that is affixed to, or part of, the lighting head and another ring gear 1408 that is affixed to, or part of, the transition plate 1402. A pinion gear 1410 is positioned in between the two ring gears 1406, 1408 and coupled to a motor either in the lighting head (not shown) or in the transition plate 1402 such that rotation of the pinion gear 1410 will cause the transition plate to rotate. Of course, other variant implementations can use, for example, a single ring gear on one of the transition plate or lighting head and a pinion gear on the other of the transition plate or lighting head such that, direct rotation of the pinion gear causes the transition plate to rotate. Still other example implementations can use crank arrangement, to convert some form of linear motion into rotational motion, or a simple shaft 1414 locked to a gear or other element by a key 1416, a chain drive, belt drive, or any other approach suitable for rotating a transition plate relative to the lighting head to which it is attached, the important aspect being the ability to rotate the transition plate through more than 360 degrees, not the specific mechanism used to do so.

Figure 15:
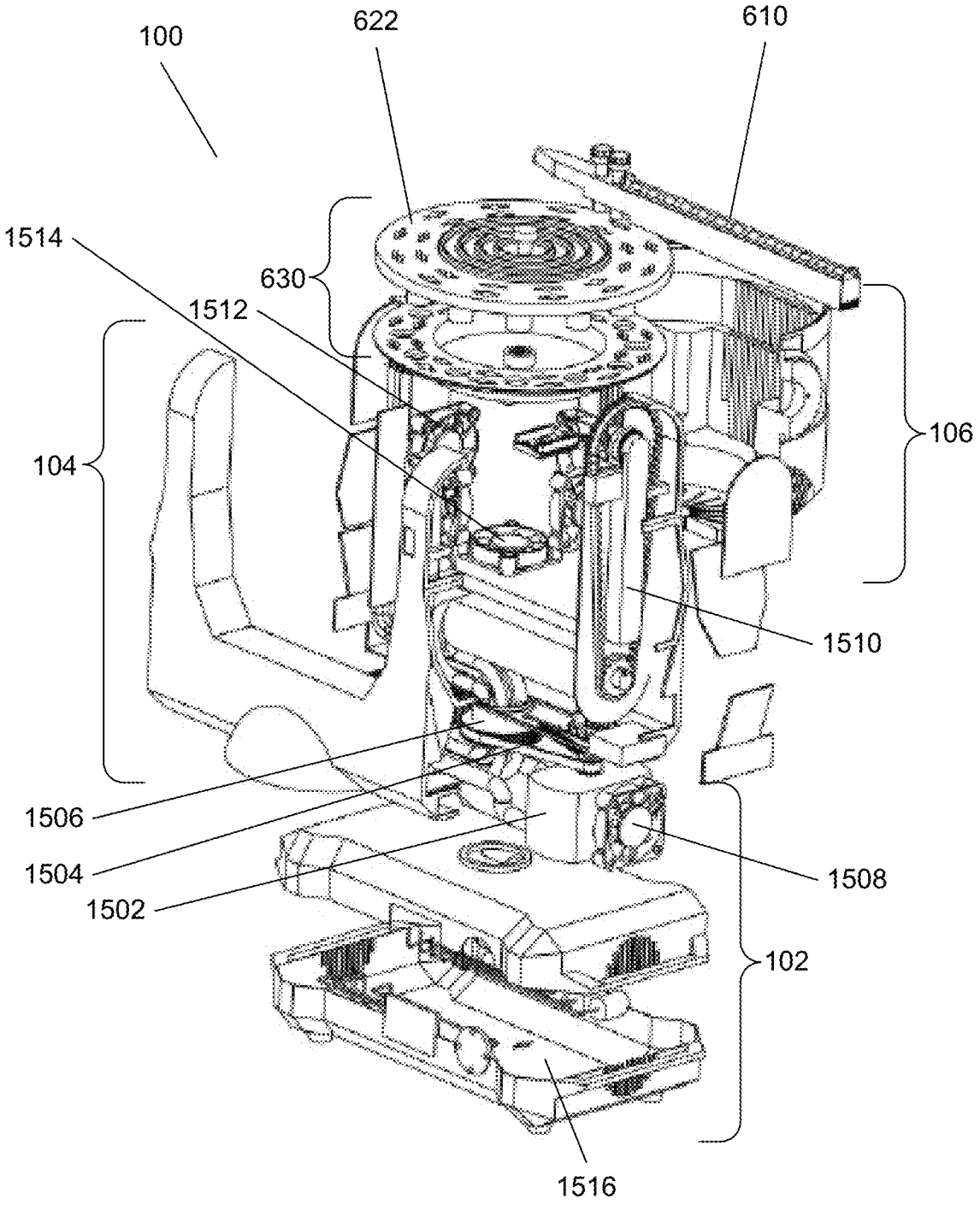
FIG. 15 is a partial exploded view of the example lighting fixture of FIG. 6 so that some of the example internal components can be seen.

In addition, as can be seen in FIG. 14, similar to FIG. 7, the transition plate 1402 includes contacts 1412 through which power and/or data can pass between the lighting head 160 and lighting elements that are coupled to the transition plate 1402. The contacts 1412 are spring loaded such that they will ride on the conductive rings of the lighting head during rotation of the transition plate 1402, irrespective of the orientation of the lighting head 106 relative to the base 102 of the lighting fixture 100. Of course, some variants can be constructed such that the conductive rings are on the transition plate and the contacts 1412 are on the lighting head. Again, the important aspect is the ability to provide for electrical conductivity (for power and/or data) between the lighting head 106 and a connected transition plate that will remain continuous while the transition plate rotates, not the particular components by which this is accomplished. FIG. 15 is a partial exploded view of the example lighting fixture 100 of FIG. 6 so that some of the example internal components can be seen, for example, a motor 1502 within the base 102 that uses a belt drive 1504 about a pulley wheel 1506 to rotate the shaft of the yoke 104. At least one fan 1508, located in the base 102 keeps the motor 1502 cool. A motorized chain drive 1510 (i.e., chain connecting at least two gears) resides in the yoke 104 and is used to rotate the lighting head 106 relative to the yoke 104.

At least one fan 1512 is also optionally located within the yoke 104 to keep the motorized chain drive 1510 cool. Similarly, the lighting head 106 includes at least one fan 1514 that is used to keep the components in the lighting head 106 and, in some implementations, the movable portion 630 (i.e., transition plate), cool.

With respect to the foregoing, it is to be understood here that any appropriate approach to keeping the components of the lighting fixture cool can be used; no particular arrangement or placement of fans or fenestrations is required. Likewise, no particular specific shape of the outer housings of the base 102, yoke 104 and/or lighting head 106 are to be implied from the drawings or descriptions herein.

Likewise, the illustrated placement of motors is only intended to be exemplary, implementations can place the motor(s) anywhere convenient provided that they directly or indirectly (through other components such as gears, linkages, cables, belts, chains, etc.) can effect the relevant movement of the appropriate component(s).

Finally, as noted above, some implementations of the base 102 optionally include extra expansion space 1516 to allow for addition of additional power supplies (e.g., to match the power demands of particular lighting module configurations) or other components (e.g., controllers, microprocessors, wireless receivers, etc.) as appropriate for the particular implementation variant.

Figure 16:
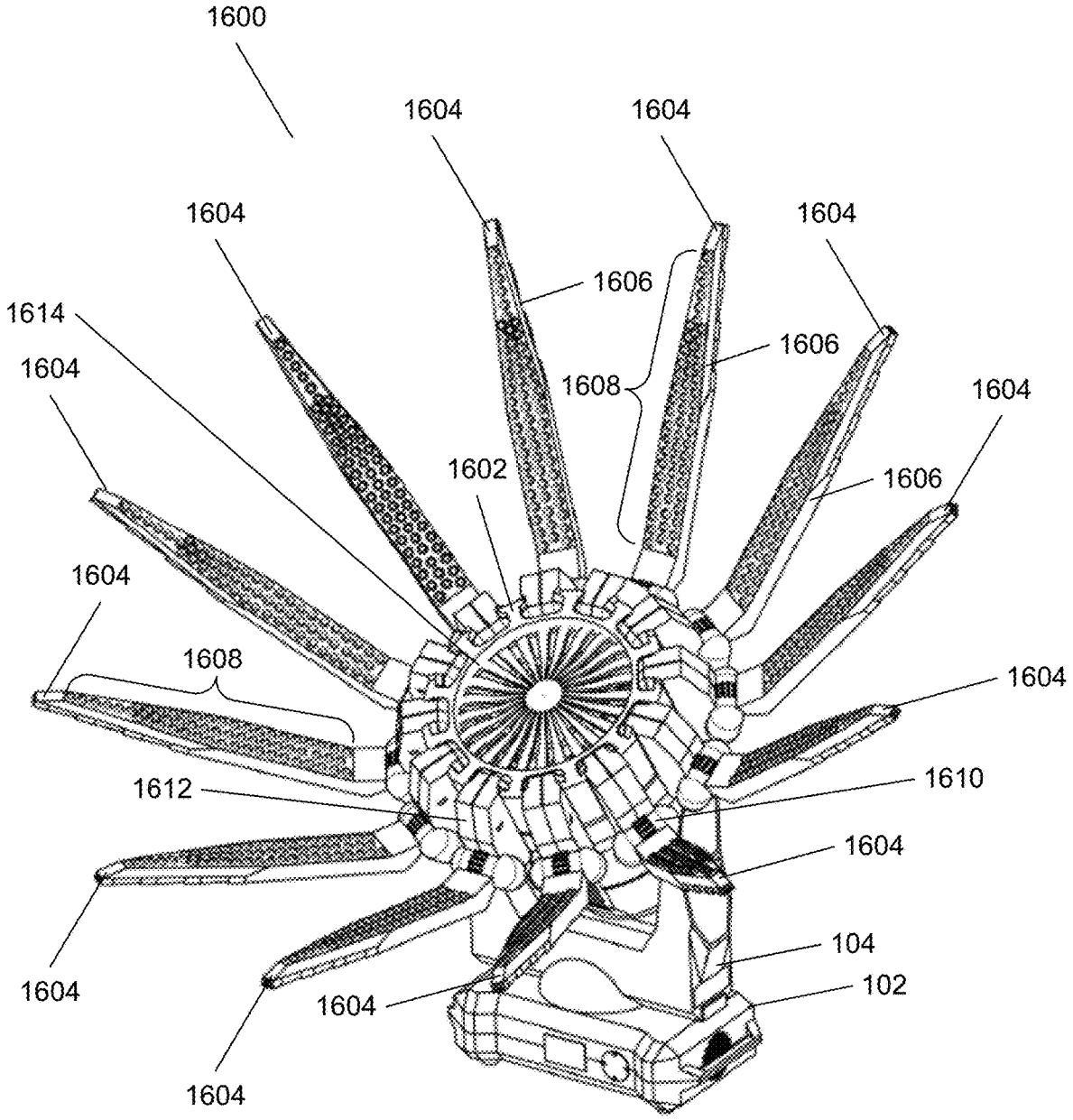
FIG. 16 illustrates, in simplified form, a more complex lighting fixture according to the teachings herein.

FIG. 16 illustrates, in simplified form, a more complex lighting fixture 1600 according to the teachings herein. As shown, this variant has a larger transition plate 1602 that, as shown, includes the capability to attach up to twelve individual lighting modules 1604. Again, as an aside, the number of lighting modules is generally limited by the physical space and some transition plates can be constructed in a tiered configuration to allow for attachment of more lighting modules than could be attached in a single plane due to physical limits.

Each of the individual lighting modules 1604 is made up of an arm 1606 containing an array of lighting elements 1608 along a common surface of the arm 1606. Each arm 1606 is connected to the transition plate 1602 by a controllable pivoting mechanism 1610 which is partially enclosed in a housing 1612.

As fenestrated cover 1614 on the transition plate 1602 provides for passage of cooling air through the transition plate 1602.

Figure 17:
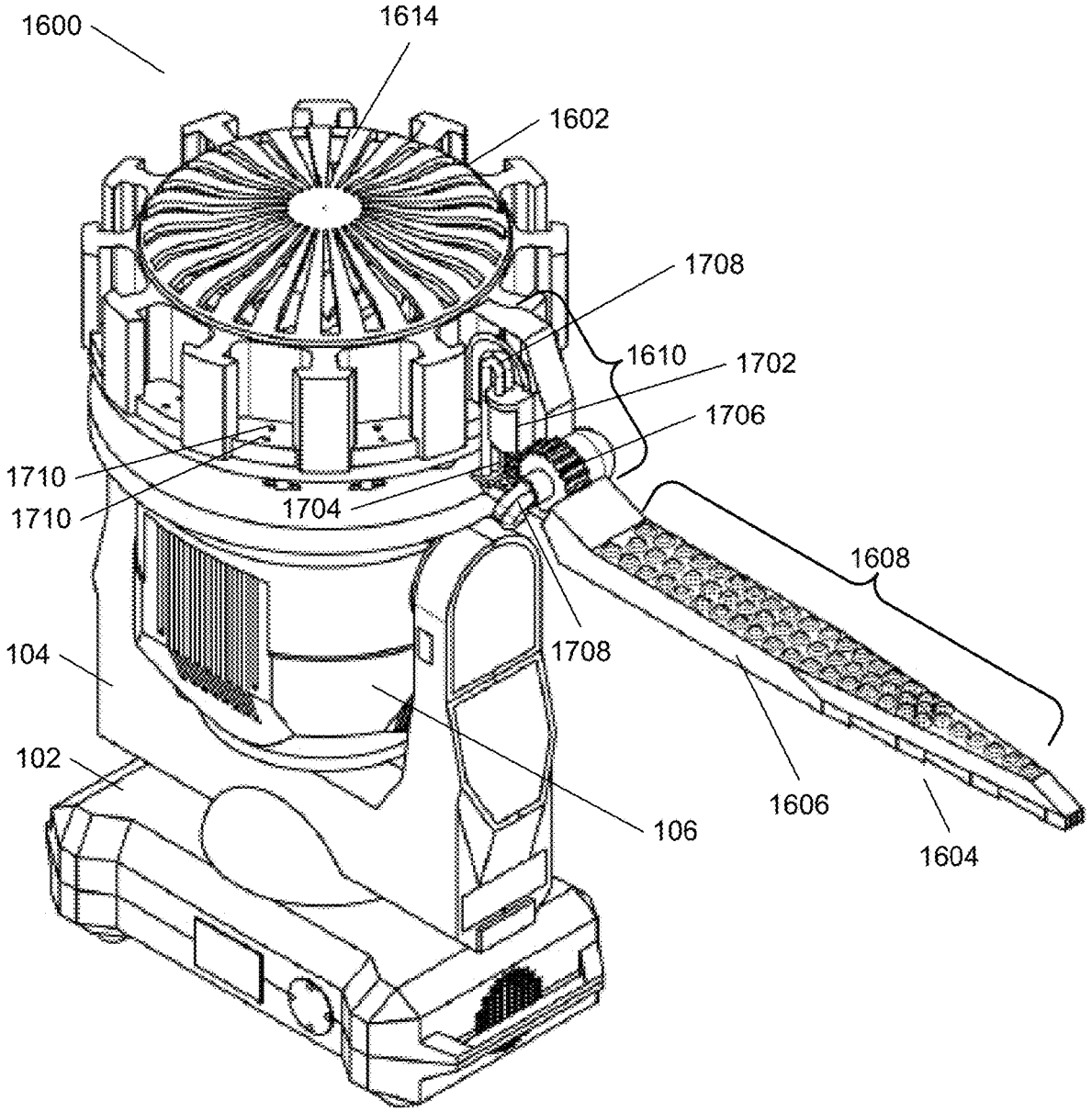
FIG. 17 illustrates, in simplified form, the lighting fixture of FIG. 16 following removal of all but one of the lighting modules.

FIG. 17 illustrates, in simplified form, the lighting fixture 1600 of FIG. 16 following removal of all but one of the lighting modules 1604. In addition, in FIG. 17, one side of the housing 1612 has been removed so that the pivoting mechanism 1610 components can be viewed. With this configuration, pivoting of an arm 1606 is accomplished using a servo or stepper motor 1702 to rotate a worm gear 1704 which, in turn, rotates a fixed gear 1706 on the arm 1606 to cause the arm 1606 to pivot relative to the transition plate 1602.

Also visible in FIG. 17 are the wires 1708 that that make up part of the electrical path to the lighting elements 1608 from the connectors 1710 on the transition plate 1602.

The housing 1612 is ideally shaped so that arms 1606 inserted into the transition plate 1602 are held solidly in place during use (i.e., to prevent undesirable radial or tangential movement) when the transition plate 1602 is rotated.

Figure 18:
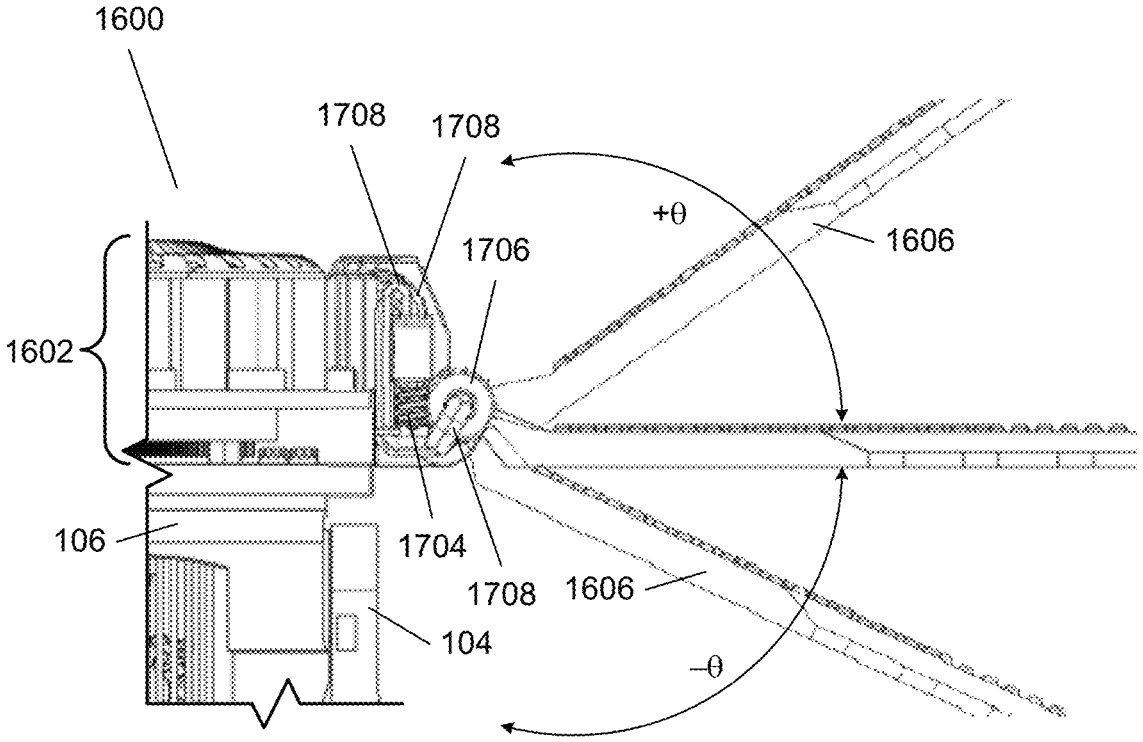
FIG. 18 is a side view of a portion of the lighting fixture of FIG. 17.

FIG. 18 is a side view of a portion of the lighting fixture 1600 of FIG. 17. FIG. 18 illustrates that the arm 1604 can pivot through a range of +/−0 relative to the position shown in FIG. 17 through use of the pivoting mechanism 1610 of FIG. 17. As shown, the full range of sweep for this type of arm 1606 is in the range of approximately 230 degrees of arc.

Figure 19:
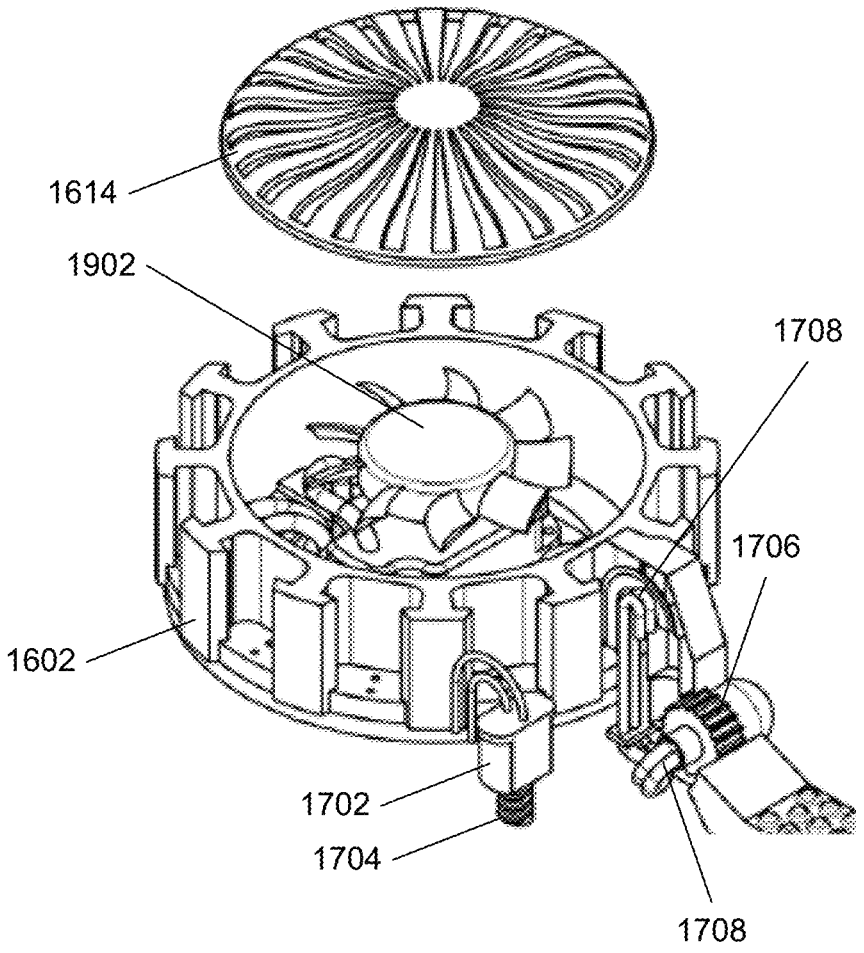
FIG. 19 is a partial exploded perspective view of the transition plate and part of the arm removed from the lighting fixture of FIG. 16.

FIG. 19 is a partial exploded perspective view of the transition plate 1602 and part of the arm 1606 removed from the lighting fixture 1600 of FIG. 16. In FIG. 19, the fenestrated cover 1614 has been removed to reveal an internal fan 1902 that is used to cool the transition plate 1602 and, in some variant implementations, to aid in cooling any lighting modules coupled to the transition plate 1602.

Figure 20:
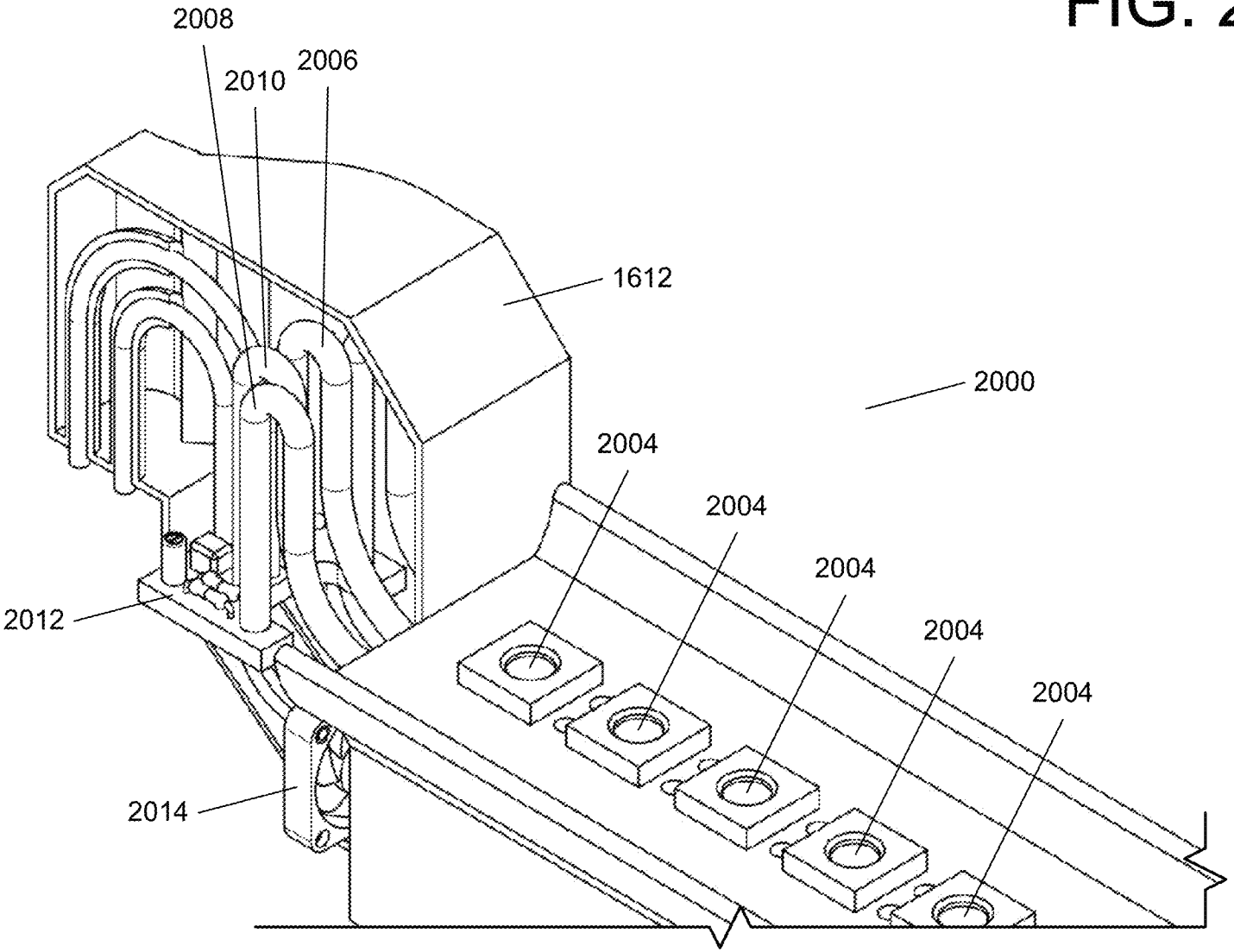
FIG. 20 illustrates, in simplified form, a partial perspective view of an alternative lighting module suitable for use with the transition plate of FIG. 16.

FIG. 20 illustrates, in simplified form, a partial perspective view of an alternative lighting module 2000 suitable for use with the transition plate 1602 of FIG. 16, where part of the housing 1612 has been removed to reveal the internal components. As shown, the lighting module 2000 is made up of an arm 2002 containing a linear array of individually controllable lighting elements 2004. This arm 2002 incorporates two wires 2006, 2008 along with a data line 2010 that is used to control, for example, whether a particular lighting element 2004 is on/off at a given time during use as specified by controller circuitry 2012. In addition, the arm 2002 contains ventilation openings (not shown) that work in conjunction with a fan 2014 located within the lighting module 2000 to cool the lighting elements 2004.

Figure 21:
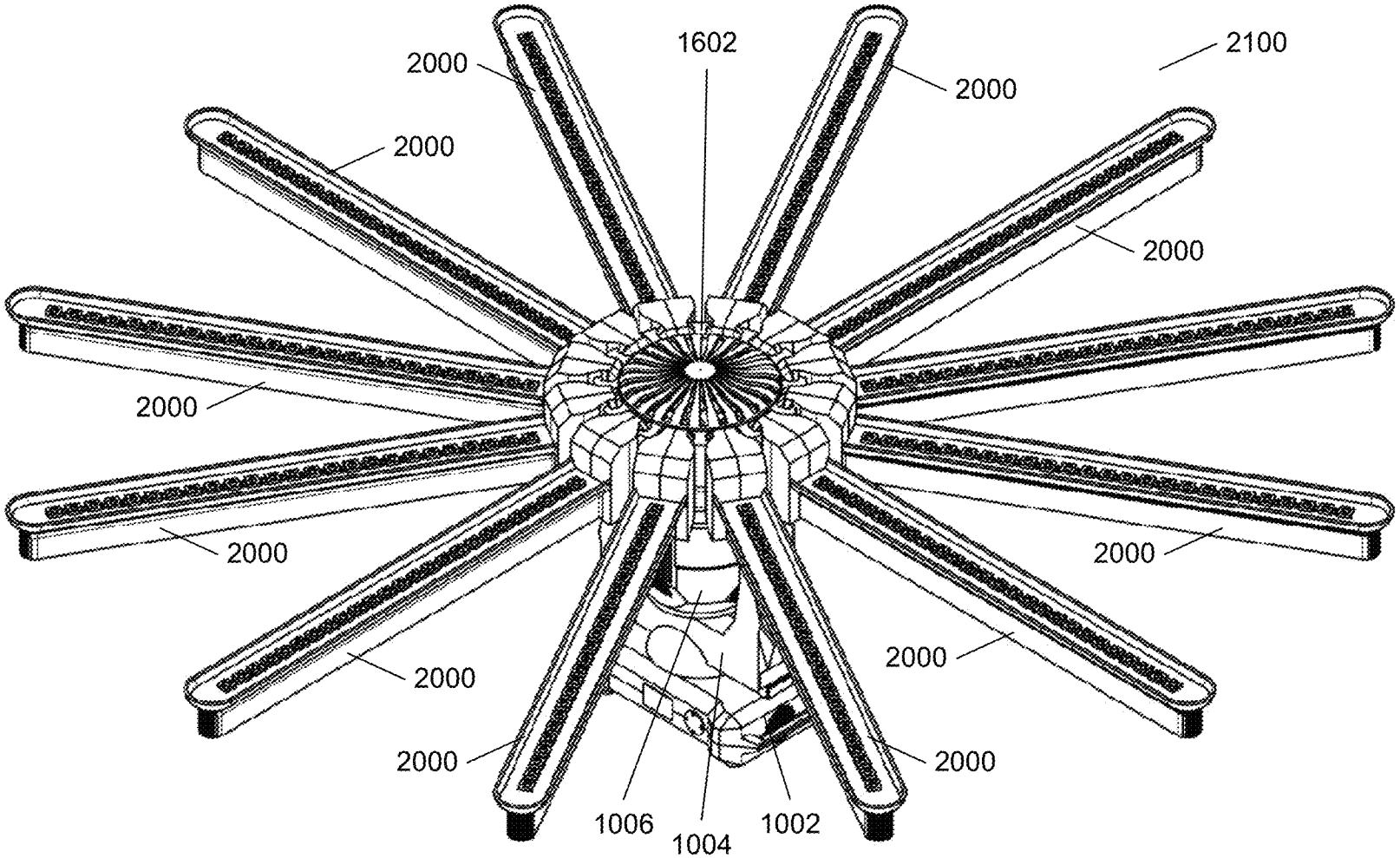
FIG. 21 illustrates, in simplified form, an alternative lighting fixture that shares the same base, yoke, lighting head and transition plate as the fixture of FIG. 16.

FIG. 21 illustrates, in simplified form, an alternative lighting fixture 2100 that shares the same base 102, yoke 104, lighting head 106 and transition plate 1602 as the fixture 1600 of FIG. 16, but replaces the lighting module 1604 with the lighting module 2000 of FIG. 20. Thus, the advantages and elegance of lighting fixtures employing the teachings herein can be more readily understood.

By employing the teachings herein, and using only the lighting modules 1604 of FIG. 16 and the lighting modules 2000 of FIG. 20, numerous different permutations and combinations of lighting fixtures can be created, involving different numbers of lighting modules, their placement, patterned combinations of lighting modules 1604, 2000 for use at different times without the need to purchase different individual conventional lighting fixtures for each different configuration.

Figure 22:
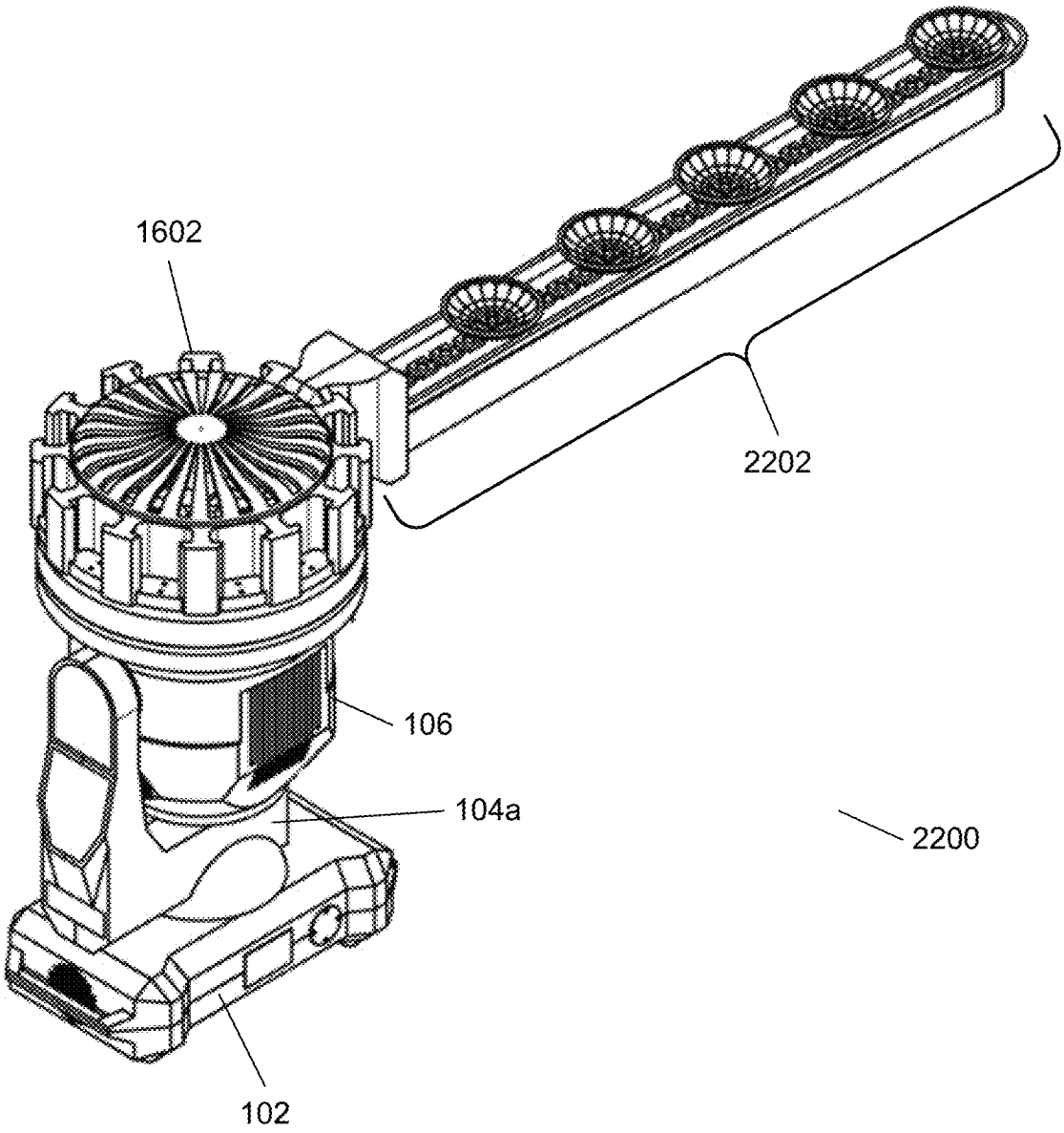
FIG. 22 illustrates, in simplified form, another lighting fixture that shares the same basic components as shown in the fixtures of FIGS. 16 and 21, except the yoke has a single arm and the lighting modules of FIG. 16 and FIG. 21 have been replaced with yet another different style lighting module.

FIG. 22 illustrates, in simplified form, another lighting fixture 2200 that shares the same basic components described above (i.e., base 102, yoke 104*a*, lighting head 106 and transition plate 1602) and as shown in the fixtures of FIGS. 16 and 21, but the fixture 2200 of FIG. 22 differs in that the yoke 104*a* has a single arm and the lighting modules 1604, 2000 of FIG. 16 and FIG. 21 have been replaced with yet another different style lighting module 2202.

Figure 23:
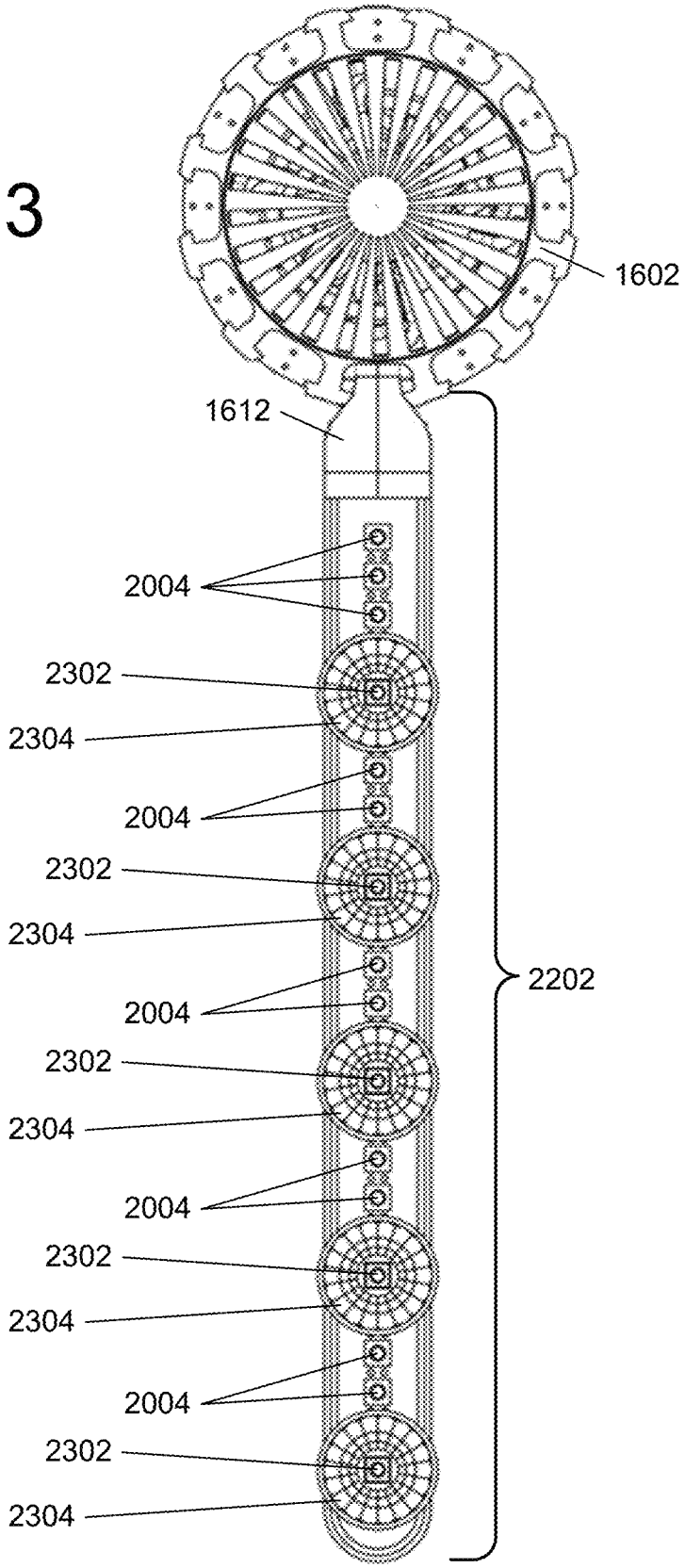
FIG. 23 is a top view of the transition plate and lighting module of FIG. 22.

FIG. 23 is a top view of the transition plate 1602 and lighting module 2202 of FIG. 22. As can be seen, the housing 1612 of this lighting module 2202 is of a shape in common with the housings 1612 of FIG. 16 and FIG. 21, and it contains a some of the linear series of lighting elements 2004, but also contains individual lighting elements 2302 each located within an individual parabolic reflector/mirror 2304 in order to be able to present different lighting effects from those that the lighting modules 1604, 2202 of FIG. 16 and FIG. 20 would provide.

Up to now, the various different configurations presented have involved lighting modules that were essentially individual linear arms. However, advantageously, lighting fixtures incorporating the teachings herein are not limited at all to those style configurations. As will now be seen, a significant advantage to the approaches described herein is that, by using a compatible connector configuration (e.g., size, shape and/or contacts) to what is present on a given transition plate, any of numerous different configuration lighting module(s) can be used without purchasing a new basic fixture 100. Moreover, as a further advantage, to the extent that different voltages or additional power may be required for a given lighting module configuration, the expansion space within the base allows for incorporation of different or additional power supplies and, because the wiring within the basic lighting fixture 100 is generally well oversized, rewiring of the basic lighting fixture 100 will not typically be required. Still further, some implementations include modularized or readily accessible wiring within the base 102 and yoke(s) 104 so that, if rewiring is ever required, due to a need to accommodate higher power, or simply for purposes of repair, that can readily be accomplished as well.

Figure 24:
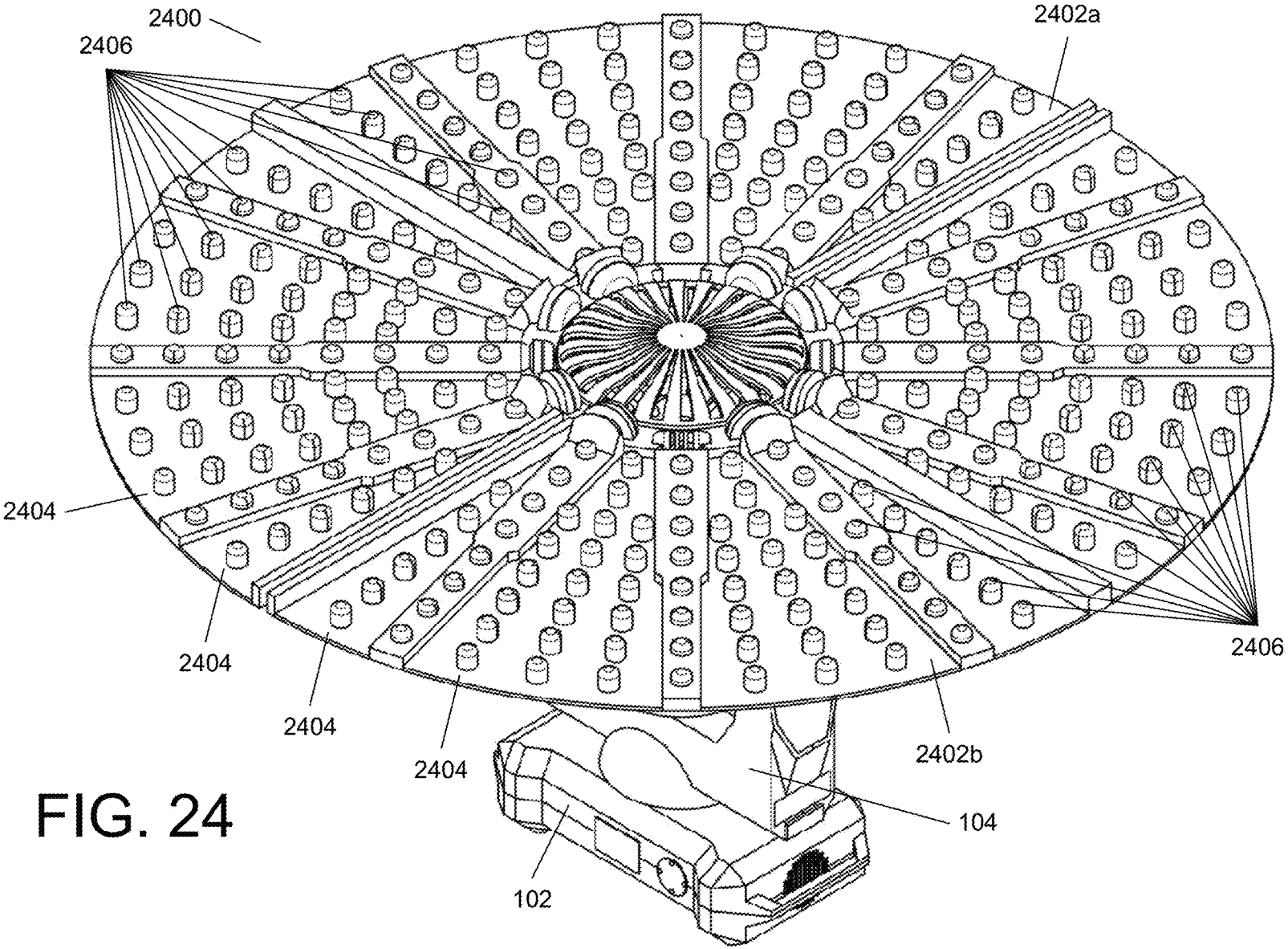
FIG. 24 illustrates, in simplified form another lighting fixture that, again, uses the same basic components described herein, but now includes a lighting unit made up of two identical, arcuate (or substantially semicircular) lighting modules.

FIG. 24 illustrates, in simplified form another lighting fixture 2400 that, again, uses the same basic components described above, but now includes a lighting unit made up of two identical, arcuate (or substantially semicircular) lighting modules 2402*a*, 2402*b*. Each lighting module 2402*a*, 2402*b* includes a series of radially extending rows 2404 of lighting elements 2406 which, as shown, also create a series of concentric circles. Depending upon the particular implementation, the lighting elements 2406 can be individually controllable, controllable by radial row, and/or controllable as circles, etc. to present entirely different lighting effects.

Figure 25:
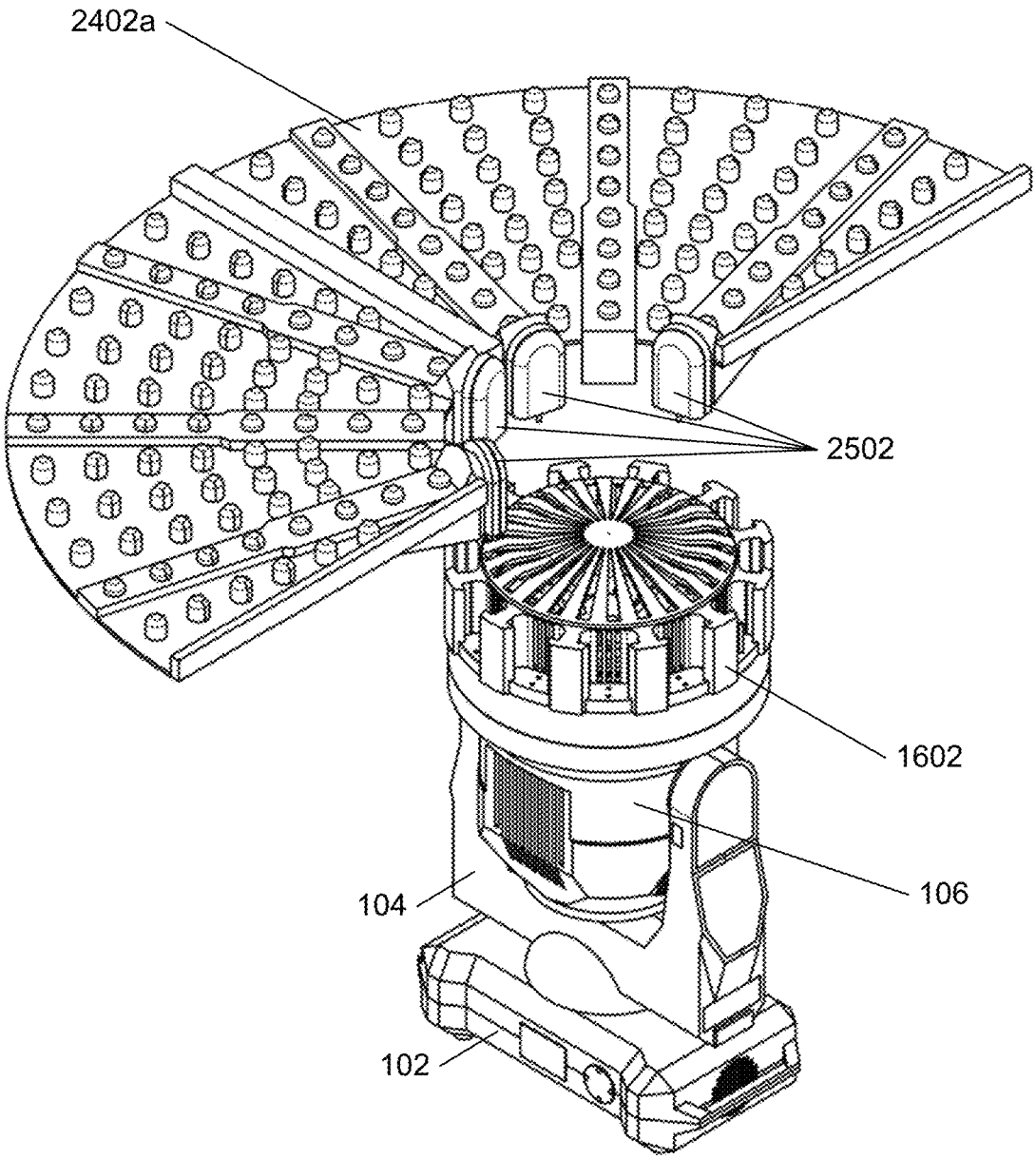
FIG. 25 is a partially exploded perspective view of the fixture of FIG. 24, with one of the lighting modules removed.

FIG. 25 is a partially exploded perspective view of the fixture 2400 of FIG. 24, with one of the lighting modules 2402*b* removed in order to show the housings 2502 that are shaped to physically, matingly, conform to the corresponding recesses of the transition plate 1602, include matingly corresponding electrical contacts that provide electrical connectivity to the transition plate contacts, and further contain the electrical circuitry to light the lighting elements.

Figure 26:
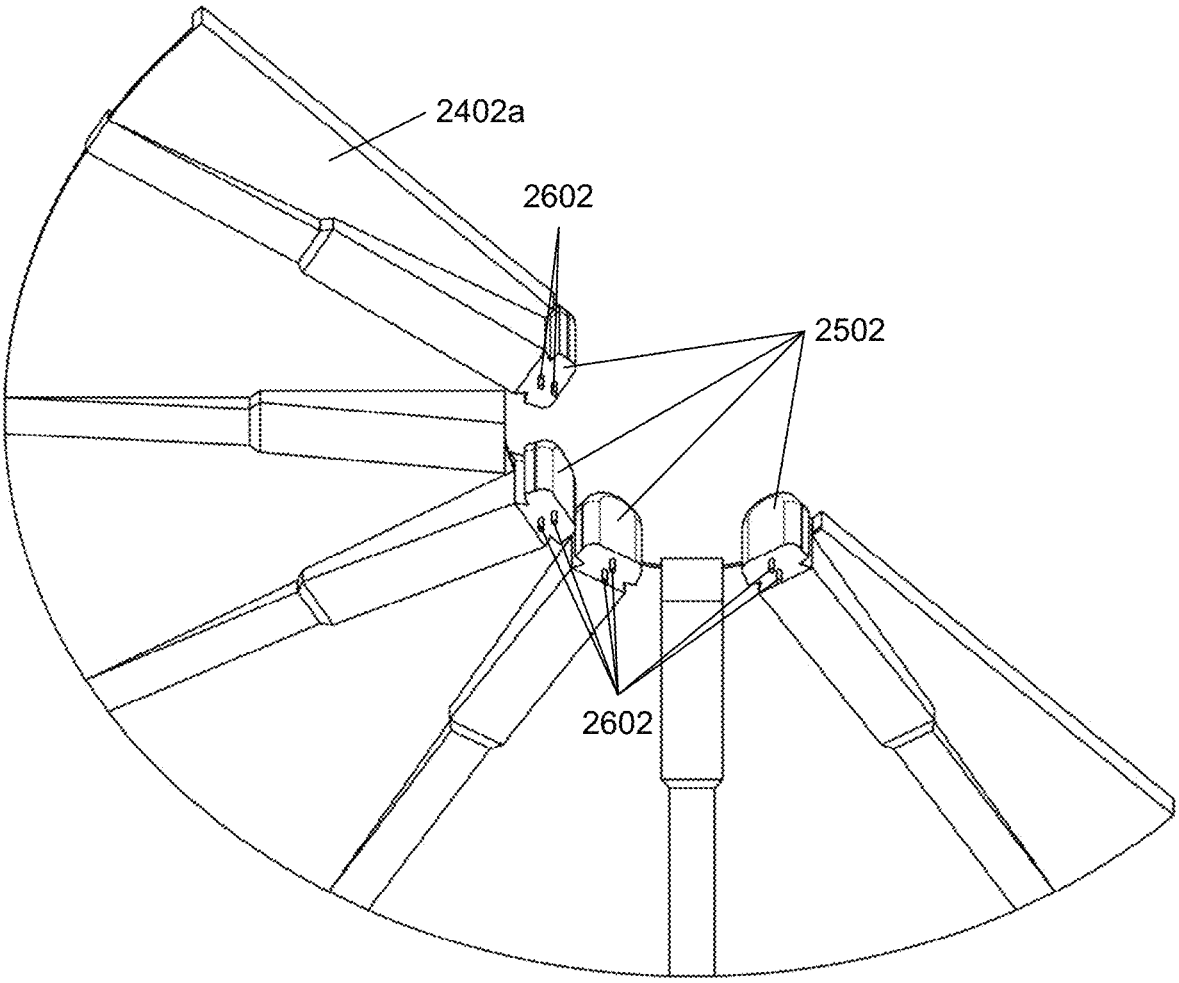
FIG. 26 is a view that shows the underside of the lighting module of FIG. 24

FIG. 26 is a view that shows the underside of the lighting module 2402*a* of FIG. 24 to show the electrical contacts 2602 on the underside of the housings 2502.

Although, FIGS. 24-25 illustrate substantially semicircular lighting modules 2402*a*, 2402*b*, it should be appreciated that other shapes, for example, arc segments could be used, whether spanning (at the periphery) more than 180 degrees, or less than 180 degrees. Indeed, based upon the fact that the transition plate 1602 of the previous few figures has 12 connection locations, lighting segments covering arcs of 30 degrees or more can be used.

Figure 27:
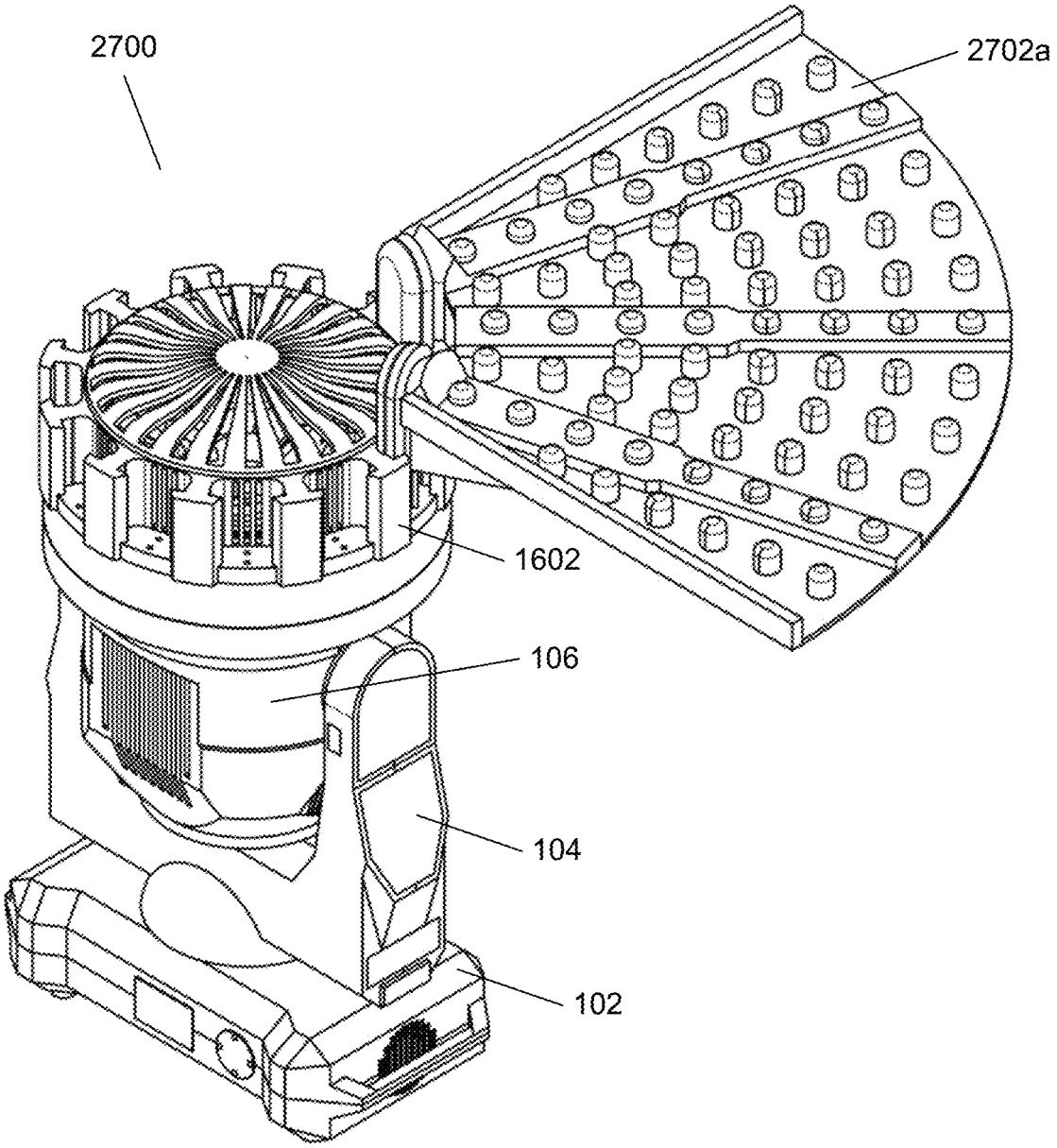
FIG. 27 shows a partially exploded view of a portion of a fixture with an alternative lighting module that is similar to the lighting module of FIG. 24, except that it covers 90 degrees of arc.

By way of simple example, FIG. 27 shows a partially exploded view of a portion of a fixture 2700 with an alternative lighting module 2702*a* that is similar to the lighting module 2402*a* of FIG. 24, except that it covers 90 degrees of arc (i.e., a quarter of a circle).

Still further, individual lighting module segments of different sizes can be created for use individually and/or in various permutations or combinations to create diverse lighting effects.

Figure 28:
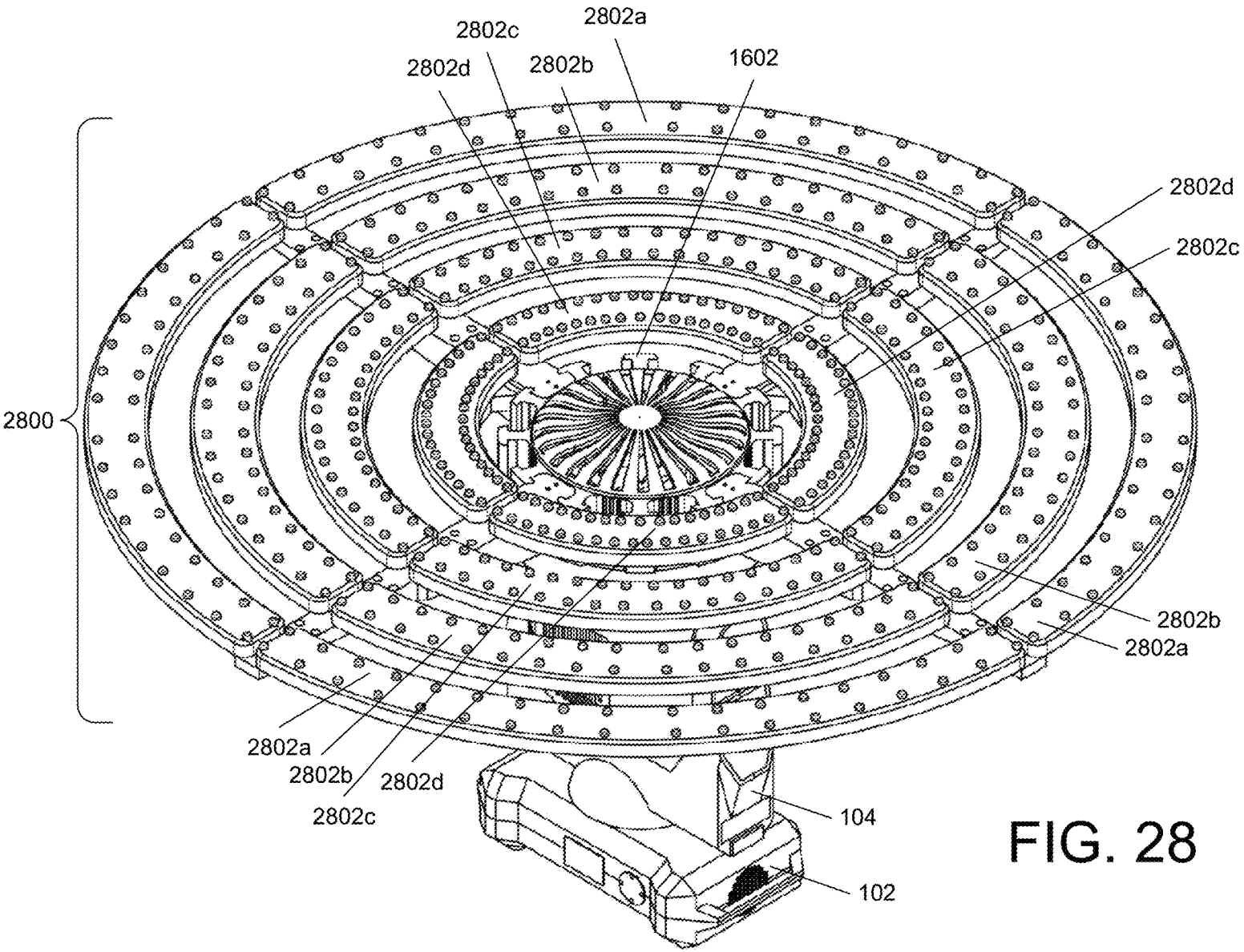
FIG. 28 illustrates, in simplified form, a perspective view of yet another lighting module that is compatible with the transition plate described above.

FIG. 28 illustrates, in simplified form, a perspective view of yet another lighting module 2800 that is compatible with the transition plate 1602 described above. As shown, this lighting module 2800 is made up of individual quarter-arc lighting sub units 2802*a*, 2802*b*, 2802*c*, 2802*d* that include their own sets of lighting elements, so they can be used individually, or in various permutations and combinations, and which, in full combination as shown, visually form four concentric rings.

Figure 29:
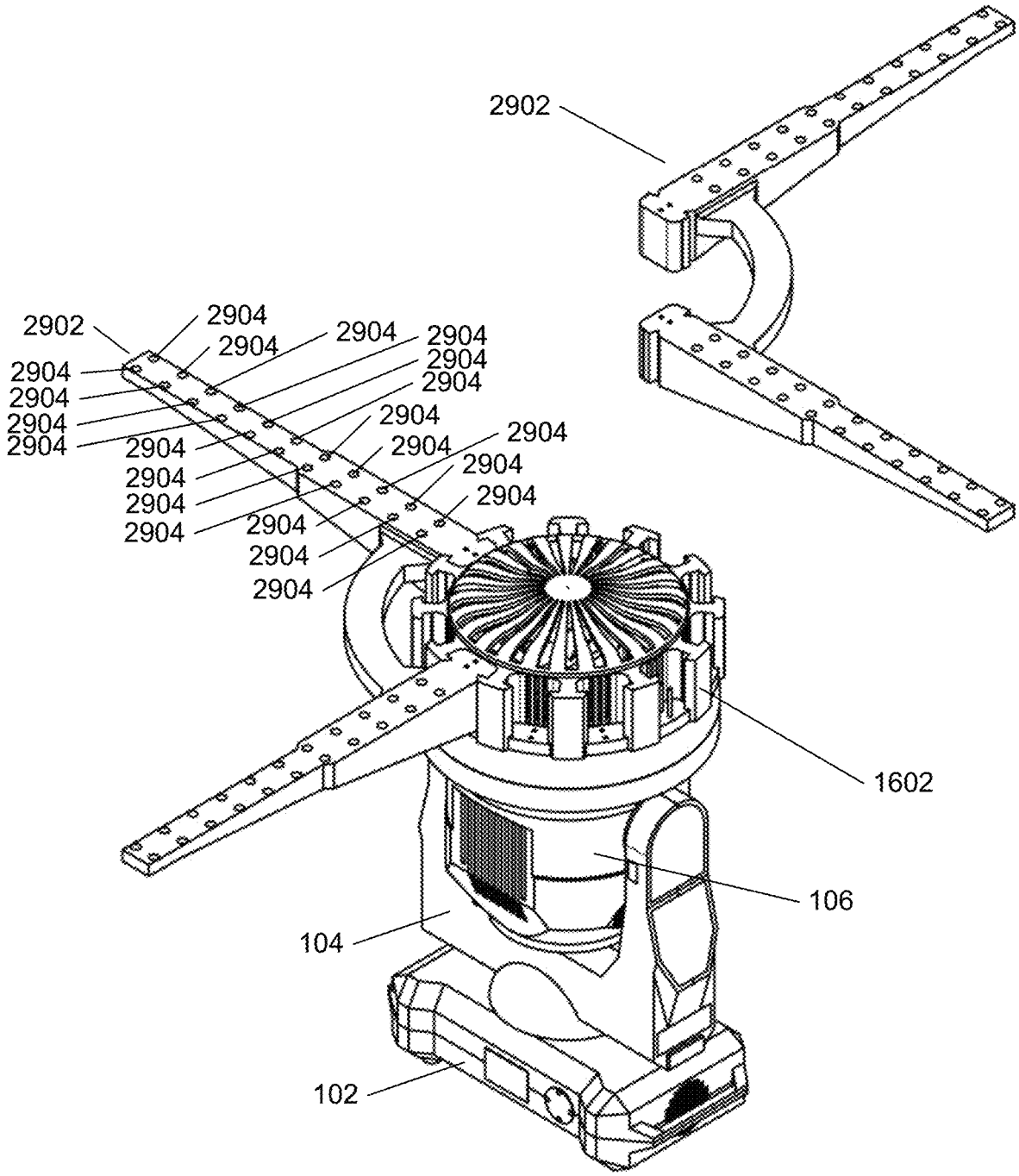
FIG. 29 is a partially exploded view of the fixture and transition plate of FIG. 28, after removal of the lighting sub units.

FIG. 29 is a partially exploded view of the fixture 100 and transition plate 1602 of FIG. 28, after removal of the lighting sub units 2802*a*, 2082*b*, 2802*c*, 2802*d* in order to show the underlying supporting arms 2902. As shown, the supporting arms 2902 include terminal portions 2904 that are shaped for physical compatible connection to the transition plate, and further include, on the underside, electrical connections (not shown) that are plug-compatible with the electrical connectors on the transition plate 1602. In addition, the supporting arms contain connection points 2904 that are used to form a physical and electrical connection between any attached lighting sub units 2802*a*, 2082*b*, 2802*c*, 2802*d* and power and/or data from the transition plate 1602.

Figure 30:
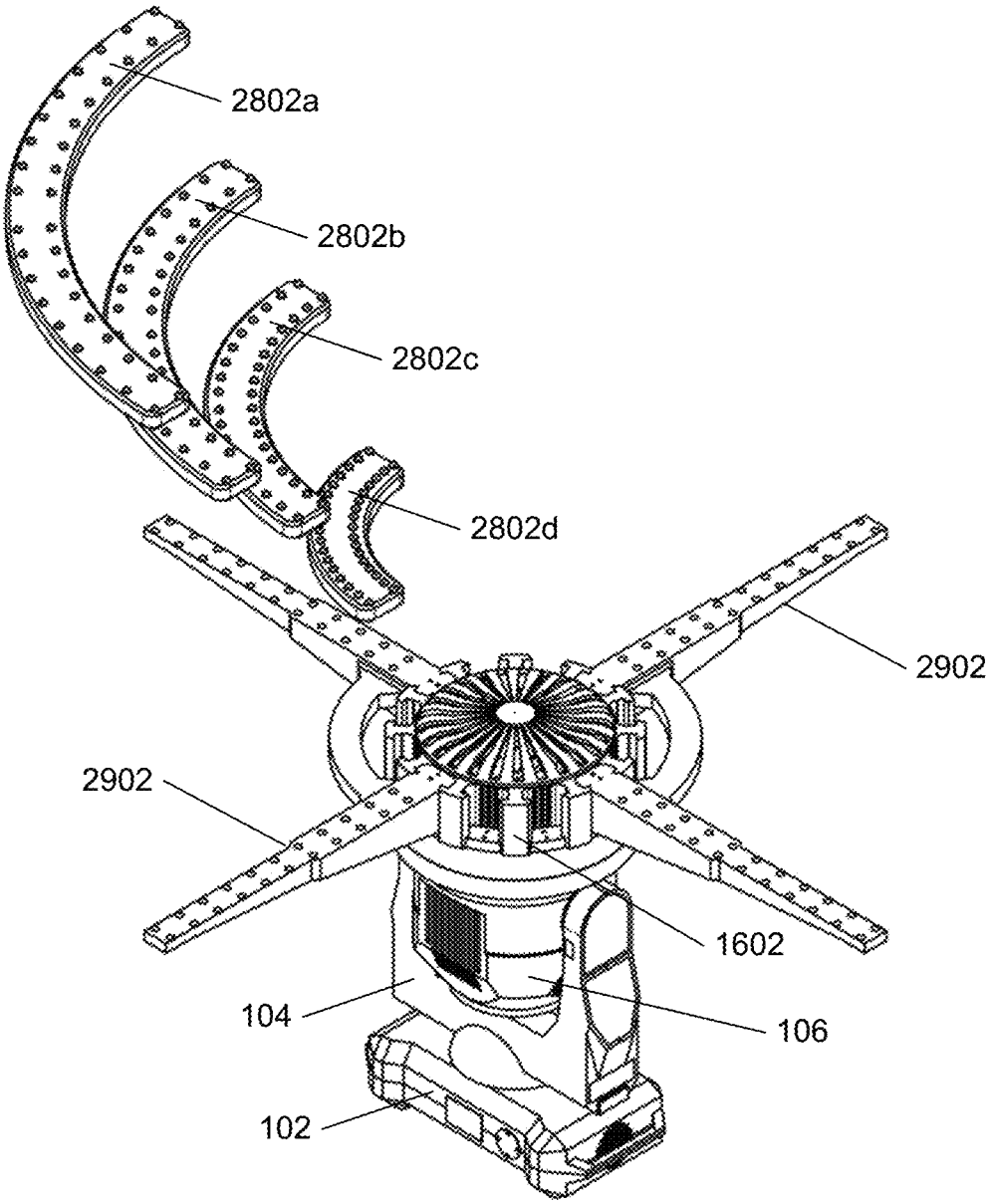
FIG. 30 is another partially exploded view of the supporting arms of FIG. 29.

FIG. 30 is another partially exploded view of the supporting arms 2902 of FIG. 29, showing four different individual lighting sub units 2802*a*, 2082*b*, 2802*c*, 2802*d* aligned for attachment to the supporting arms 2902 via the connection points 2904 of FIG. 29.

Up to now, the various implementation examples have focused on lighting modules made up of multiple lighting elements. However, that is not a requirement. Advantageously, the teachings herein enable creation of lighting fixtures involving two or more lighting modules, where the individual lighting modules contain a single lighting element such that the span (width) of the lighting head of the lighting fixture with either the lighting elements, and/or the lighting elements and transition plate combination, attached is larger than the span of the lighting head alone.

Figure 31:
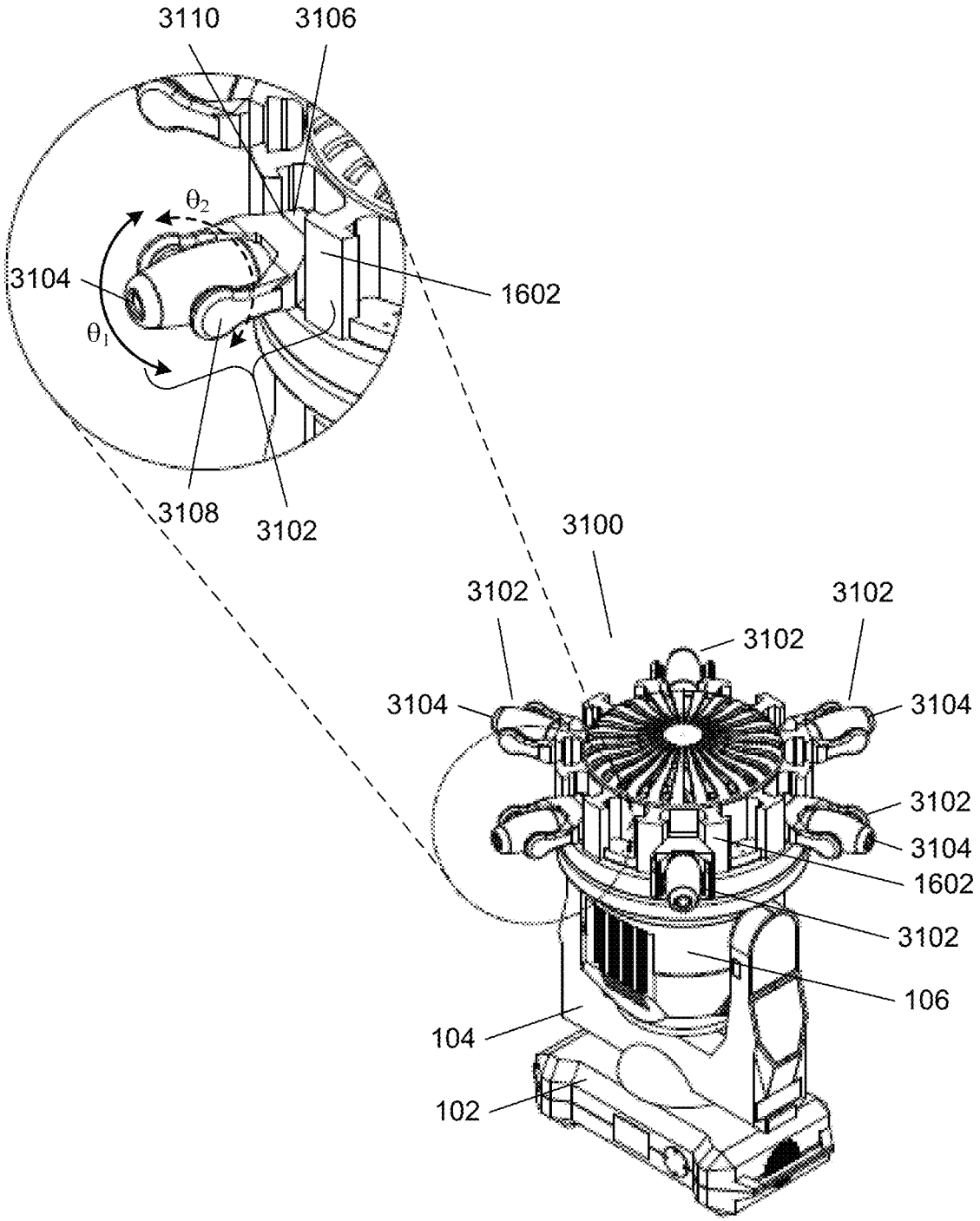
FIG. 31 illustrates, in simplified form, another lighting fixture that uses the same basic fixture components and transition plate previously described and includes individual lighting modules of a single lighting element each.

FIG. 31 illustrates, in simplified form, another lighting fixture 3100 that uses the same basic fixture components 102, 104, 106 and transition plate 1602 previously described and includes individual lighting modules 3102 of a single lighting element 3104 each.

The lighting modules 3102 include a coupling 3106 that is shaped so as to form a mating physical connection to allow it to couple to the transition plate 1602 as well as electrical contacts (not shown) that matingly couple to the corresponding connection points of the transition plate 1602. Thus, as can be seen, for the configuration shown, as few as one and as many as twelve individual lighting modules 3102 of this type can be used, or can be mixed and matched with, for example, other lighting modules described herein. Moreover, depending upon the particular implementation, an individual lighting module 3102 need not be constructed so as to only be maintained in a fixed position. Rather, as is shown in the enlarged view of FIG. 31, an individual lighting module 3102 can optionally be constructed so that the lighting element 3104 is held by its own yoke 3108 that allows the lighting element 3104 to be pivoted through some angle $\theta_1$, either manually during set up or, using a small motor and/or gear or linkage arrangement, automatically (in a controlled or random manner) during use. Similarly, some implementations can further include an additional movable swivel joint 3110 that can allow the lighting element 3104 to be swiveled or rotated through an angle $\theta_2$, while it is in a pivoted position or being pivotably moved. Depending upon the particular implementation, the angle $\theta_1$ will typically be an angle of less than 270 degrees and, more likely, 180 degrees or less (although some can be implemented to pivot through angles of up to 360 degrees or more). In contrast, depending upon the particular implementation, the angle $\theta_2$ will typically allow for rotation of up to 360 degrees or more, but, of course, implementations that only provide for smaller rotations can be constructed as well.

Now, as briefly noted above, a further advantage available from some implementation variants is, through use of a common connection shape and electrical connections to those on a transition plate, two or more of the same or different lighting modules can be directly coupled to each other in order to create even more elaborate or unusual lighting or lighting effects.

FIG. 32 illustrates, in simplified form, a lighting fixture that shares the same basic components base 102, single arm yoke 104*a*, lighting head 106, and transition plate 1602 as in some of the previous fixtures, to which has been coupled a lighting module 3202 in the form of an arm 3204 having three linear rows 3206 of lighting elements. In addition, a remote end 3208 of the lighting module 3202 includes a connector 3210 that has a shape and electrical connection points in common with the transition plate 1602. As a result, a further lighting module, in this example the lighting module 3102 of FIG. 31, can be attached to the remote end 3208. As an aside, when not in use, the remote end 3208 can be covered by a cap (not shown) if desired.

FIG. 33 illustrates, in simplified form, a top view of an example of a compound lighting module 3300 made up of the transition plate 1602 and six complex lighting modules made up of pairs of the individual lighting modules 3202, 3102 of FIGS. 32 and 31.

Up to now, the foregoing description has largely focused on the versatility of having a lighting fixture with common basic components (base, yoke(s), lighting head, transition plate(s)) that is constructed to accept one or more lighting arrays having an extent ($W_2$ of FIGS. 1-2) that is larger than the extent ($W_1$) of the lighting head itself. However, as noted previously, through use of an additional yoke coupled to the main yoke, further advantages can be achieved, over an above compactness for transport. For example, through use of an additional yoke (which can be further extended to even a third or fourth yoke), larger, and/or more complex, lighting modules can be accommodated, particularly if, during use, the lighting modules will rotate or move. In addition, the addition of one or more additional yokes allows for translational movement of the lighting head (and consequently lighting modules) not previously available. Still further, even if the yokes will remain in fixed positions during use, through use of more than one yoke, greater mounting flexibility is available, since the additional translation capability can allow the fixture to potentially avoid what would be a mounting impediment for current automated lighting fixtures.

Figure 34:
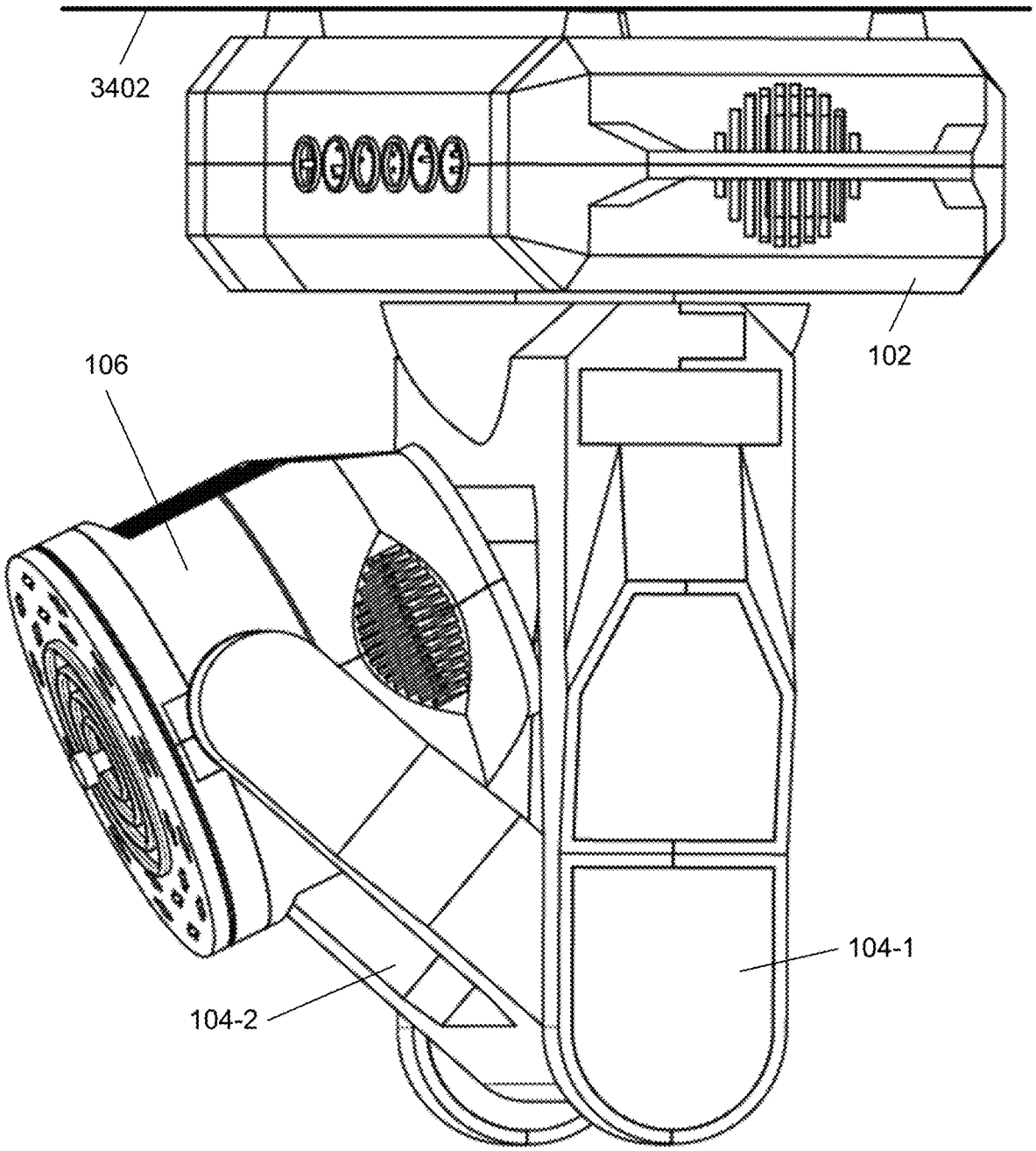
FIG. 34 shows an example basic lighting fixture, constructed according to the teachings herein, mounted to a ceiling or other overhead support.

In this regard, FIG. 34 shows an example basic lighting fixture 3400, constructed according to the teachings herein, mounted to a ceiling or other overhead support 3402. More particularly, the fixture 3400 is made up of a base 102, and lighting head 106 as described herein, but also includes a main yoke 104-1, coupled to the base 102, and a secondary yoke 104-2 coupled between the main yoke 104-1 and lighting head 106. As shown, this fixture 3400 is in a substantially "retracted" position—meaning that the lighting head 106 is positioned close to the base 102.

Figure 35:
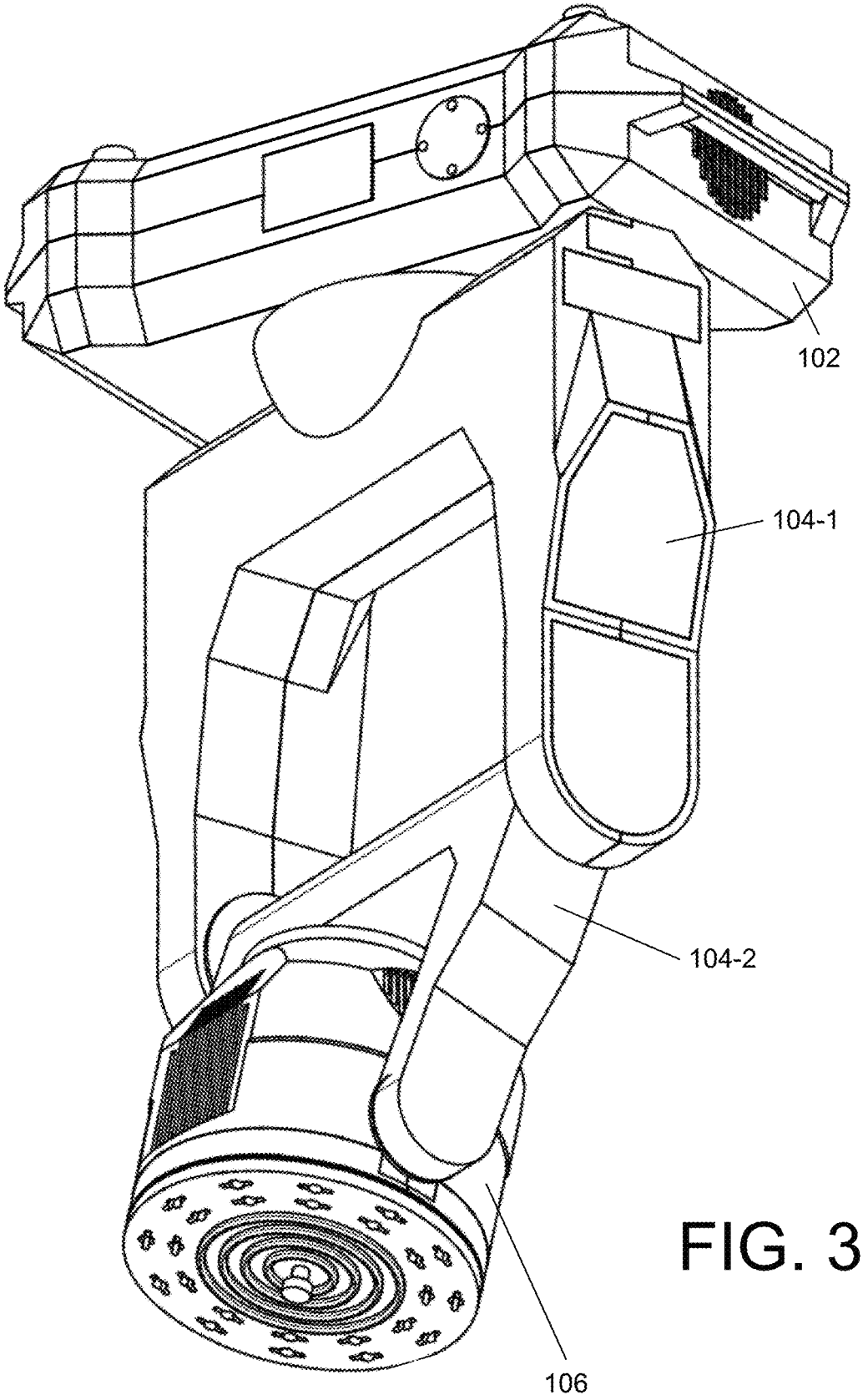
FIG. 35 shows the same lighting fixture of FIG. 34, except that the secondary yoke has been pivotably moved so that the lighting head is nearly fully extended.

In contrast, FIG. 35 shows the same lighting fixture 3400 of FIG. 34, except that the secondary yoke 104-2 has been pivotably moved so that the lighting head is nearly fully extended—meaning that the lighting head 106 is positioned almost as far from the base 102 as possible. In this manner, a large lighting module that could not be coupled to the lighting head because, in use, it would impact or be interfered with by the ceiling or overhead support 3402 can now be accommodated without repositioning the base.

Figure 36:
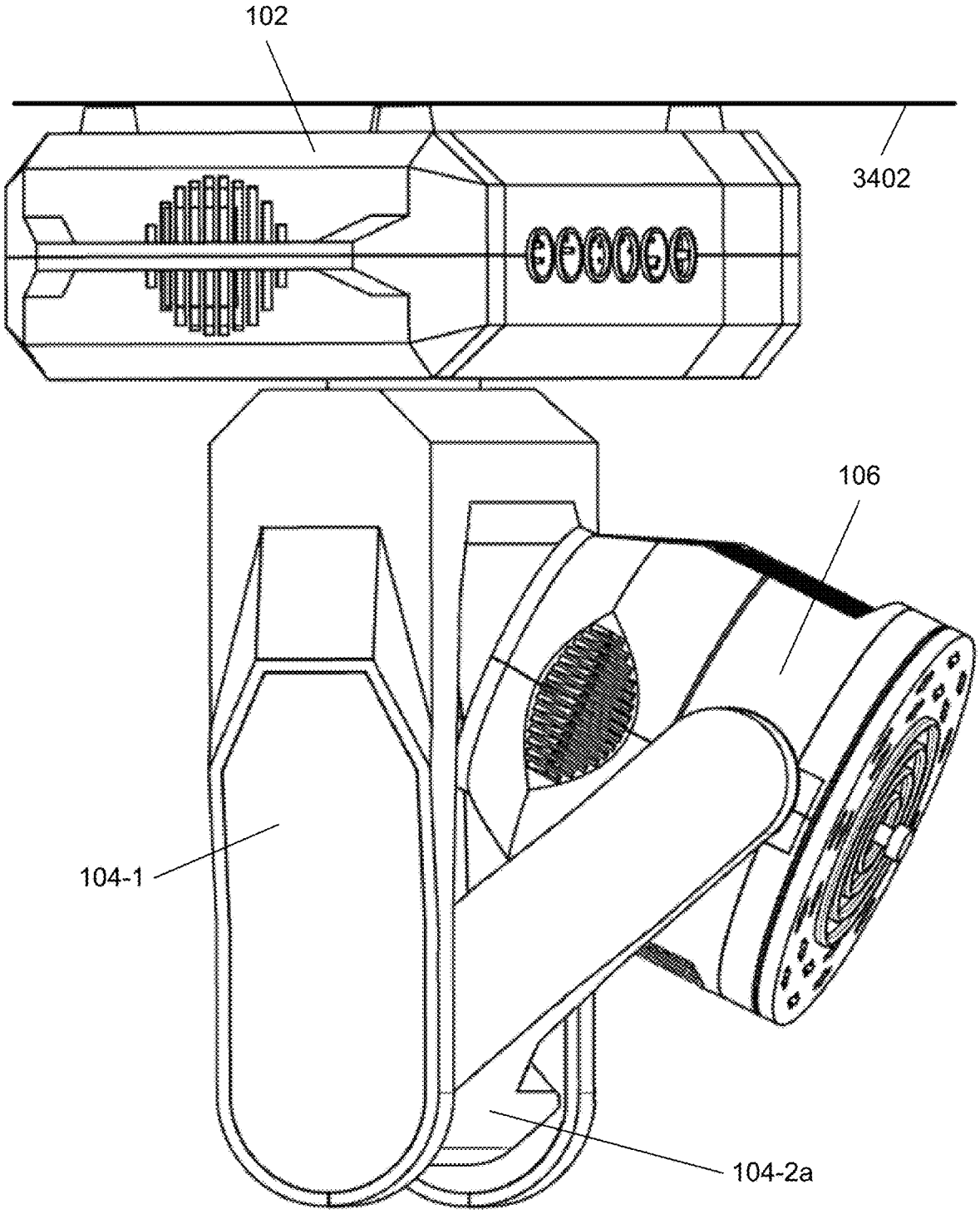
FIGS. 36-37 illustrate a lighting fixture similar to that of FIGS. 34-35, except that, in FIGS. 36-37, the secondary yoke has a single arm.
Figure 37:
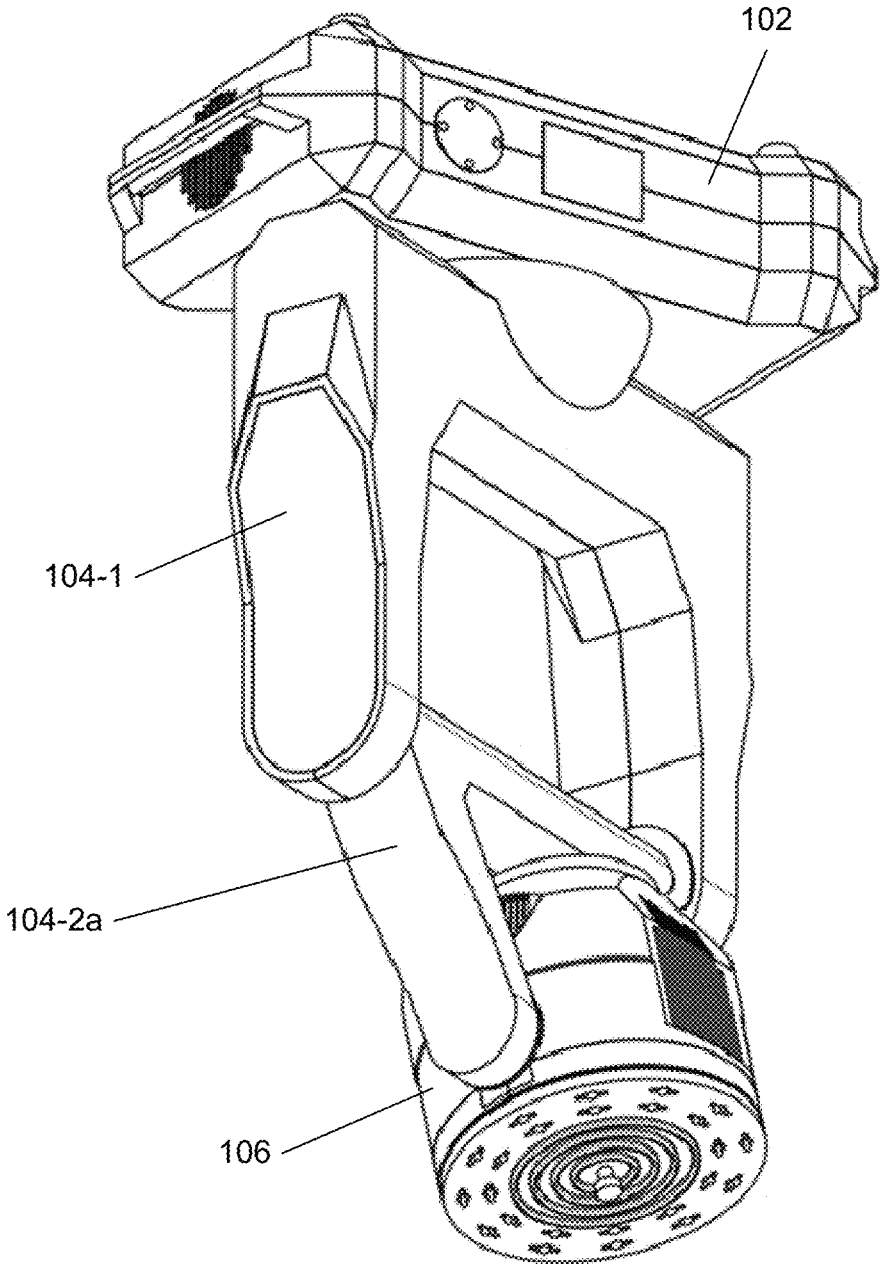

FIGS. 36-37 illustrate a lighting fixture similar to that of FIGS. 34-35, except that, in FIGS. 36-37, the secondary yoke 104-2*a* has a single arm, instead of the two arms of the secondary yoke 104-2 of FIGS. 34-35.

Advantageously, through use of multiple fixtures, each with multiple yokes, the lighting fixtures can be positioned at a venue such that they can individually provide their respective lighting for some time period and then the respective lighting arrays can be moved (without moving their respective bases 102) to positions such that they can collectively act as a single lighting display (e.g., individual lighting arrays that are video display panels and provide independent images can be moved relative to each other so as to collectively form a single large, unified, display for some period of time, but can them be moved apart and, again, provide individual displays.

Figure 38A:
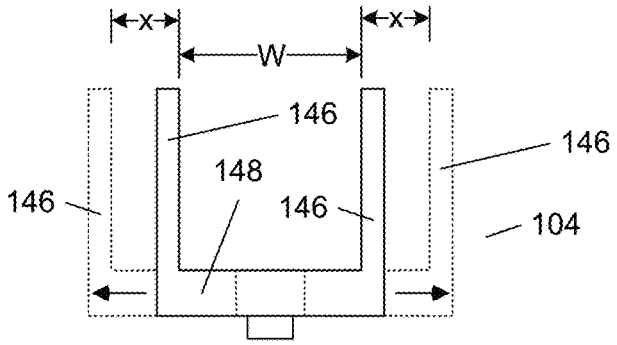
FIGS. 38A-38C illustrate, in simplified form, yokes that are extensible/retractable and suitable for use as described herein.
Figure 38B:
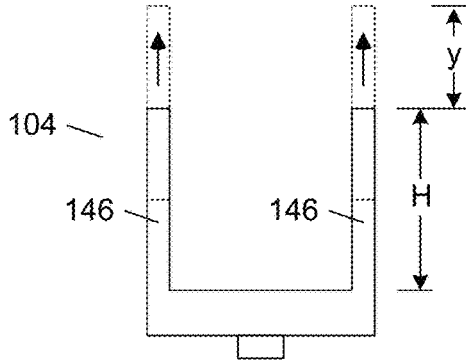
Figure 38C:
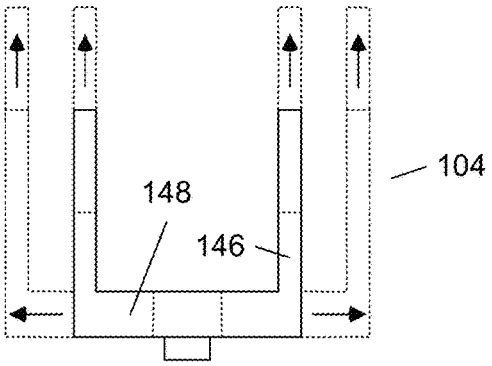

FIGS. 38A-38C illustrate, in simplified form, yokes 104 that are extensible/retractable and suitable for use as described herein.

More particularly, FIG. 38A illustrates, a yoke 104 that has a telescoping crossbar 148 that can be extended and/or retracted in order to change the spacing of the arms 146 so they can accommodate different width lighting heads 106 so that an entire family of lighting heads might potentially be used with the same yoke 104.

In a related vein to that of FIG. 38A, FIG. 38B illustrates, in simplified form, a yoke 104 that has telescoping arms 146 so that different length lighting heads can be used with the same yoke 104.

FIG. 38C illustrates, in simplified form, a yoke 104 that incorporates the extensibility/retractability of both the crossbar 148 and arms 146 as shown in FIGS. 38A-38B in a single yoke 104.

With respect to FIGS. 38A-38C, to the extent that wiring needs to pass through one or both arms to the lighting head (as occurs with current, conventional, lighting fixtures of this type, mating connectors (of a type/size/shape common to all possible configurations) can be used at the connection point between the yoke 104 and lighting heads 106 so that, depending upon the particular implementation, remain in a fixed position when the lighting head 106 moves relative to the yoke 104 or can, for example, pivot or swivel as needed.

Although the extension is shown for a yoke with two arms 146, it should be understood that the foregoing is equally applicable to a yoke with a single arm, as well as to any of the individual yokes in implementations containing two or more yokes.

Figure 39:
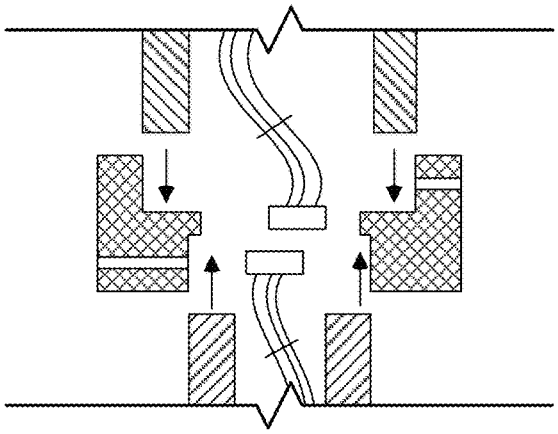
FIG. 39 illustrates, in simplified form, one example approach that allows for swapping of yokes with a common base.

In addition, some implementations of the teachings described herein can be further modularized such that one yoke can be swapped for another, even with different shaft diameters or sizes. This can be handled as illustratively shown in the cross section of FIG. 39 which illustrates, in simplified form, one example approach that allows for swapping of yokes 104 with a common base 102. One portion 3902, which can be a shaft of a yoke 104 or a component of the base to which the shaft of the yoke needs to connect, has a specific diameter/size and wiring 3904 that forms a part of, for example, the power path between the power suppl(y/ies) of the base 102 and a lighting head 106. Another portion 3906, which also can be a shaft of a yoke 104 or a component of the base to which the shaft of the yoke needs to connect, but is of a different size, likewise has wiring 3908 that forms another part of, for example, the power path between the power suppl(y/ies) of the base 102 and a lighting head 106. A coupling 3910 that, on one side matches the size/shape of the first portion 3902 and on the other side matches the size/shape of the second portion 3906 can be interposed between the two portions 3902, 3906 to join the portions together. Depending upon the particular implementation, different mechanisms can be used to lock the coupling 3910 to each portion 3902, 3906, for example, a set screw, locking pin, clip, or any other appropriate mechanism can be used that will hold the two together with sufficient strength during use, but can be released when a change is required. As shown, the coupling 3910 includes openings 3919 to accommodate the selected locking mechanism(s). In addition, and similar to the connection between the yoke 104 and lighting head 106, removably mating connectors 3912*a*, 3912*b* can be used to allow for easy disconnection of one yoke and reconnection of another yoke without requiring rewiring of the fixture. Of course, it shoudl be understood that this approach can be used whether the shaft of the new yoke 104 is larger, smaller or the same size as the one it will replace.

Finally, a further advantage to the foregoing is that a family of modularized lighting fixtures of different sizes, weight handling capacity, and/or power capacity can be created. that can make use of some or all of a common family of lighting modules and/or lighting arrays, thereby addressing problems with current, conventional fixtures and new effects are desired or technology changes.

Having described and illustrated the principles of this application by reference to one or more example embodiments, it should be apparent that the embodiment(s) may be modified in arrangement and detail without departing from the principles disclosed herein and that it is intended that the application be construed as including all such modifications and variations insofar as they come within the spirit and scope of the subject matter disclosed.

What is claimed is:

1. A lighting fixture comprising a base;

at least one yoke, comprising at least one arm and a shaft, the at least one yoke being coupled to the base via the shaft, and controllably, rotatably, moveable relative to the base via at least a first motor;

a lighting head coupled to the at least one yoke, wherein the lighting head is controllably rotatably movable, relative to the at least one arm of the at least one yoke, via at least a second motor, wherein the lighting head has a first extent at a lighting output side;

a transition plate having multiple connection ports through which power can pass from the lighting head to a lighting array, the lighting array comprising one or more lighting modules;

wherein the lighting array has a second extent that is greater than the first extent of the lighting head; and wherein the lighting head includes an electrically conductive coupling which will allow the transition plate to be rotated relative to the lighting head, through at least one revolution, while maintaining a continuous electrical path between the lighting head and lighting array when a particular lighting array is coupled to the transition plate and the transition plate is coupled to the lighting head.

2. The lighting fixture of claim 1, wherein at least one of the lighting head or the transition plate includes at least a third motor that will, when the lighting array is coupled to the lighting head, controllably move at least a part of the lighting array, relative to the transition plate, between a first position and a second position.

3. The lighting fixture of claim 1, wherein the at least one yoke comprises:

a first yoke including the shaft and two auxiliary arms, and a second yoke including the at least one arm;

wherein the second yoke is movably coupled to the two auxiliary arms of the first yoke.

4. The lighting fixture of claim 1, wherein the lighting array comprises:

a lighting arm; and multiple individual lighting elements positioned on the lighting arm.

5. The lighting fixture of claim 4, wherein the lighting arm comprises at least two segments.

6. The lighting fixture of claim 5, wherein one of the at least two segments is controllably movable relative to another of the at least two segments in a longitudinal direction.

7. The lighting fixture of claim 5, wherein one of the at least two segments is controllably pivotably movable relative to another of the at least two segments.

8. The lighting fixture of claim 4, wherein the lighting arm has a proximal end and a distal end and wherein lighting arm couples to the transition plate at the proximal end and includes a connector near its distal end to which an auxiliary lighting module can be attached.

9. The lighting fixture of claim 8, wherein the auxiliary lighting module is independently moveable.

10. The lighting fixture of claim 1, wherein the transition plate includes multiple movable lighting elements coupled thereto.

11. The lighting fixture of claim 1, further comprising, to move the transition plate relative to the lighting head, at least a pair of ring gears, one ring gear of the pair is coupled to the transition plate and an other of the pair coupled to the lighting head, wherein the pair of ring gears are interconnected such that rotation of one ring gear of the pair causes rotation or the other ring gear of the pair.

12. The lighting fixture of claim 1, further comprising:

a lighting module, including multiple lighting elements, electrically connected to the transition plate via one of the connection ports.

13. The lighting fixture of claim 12, wherein the lighting module further comprises:

a motor; and a pivot about which a portion of the lighting module can be moved by the motor.

14. The lighting fixture of claim 12, wherein the lighting module further comprises:

a lighting segment having thereon, multiple lighting elements arranged in an arc.

15. The lighting fixture of claim 14, wherein the multiple lighting elements comprise an array of at least two rows of multiple lighting elements.

16. The lighting fixture of claim 12, wherein the lighting module further comprises:

a lighting segment having thereon, a linear array of at least two rows of multiple lighting elements.

17. The lighting fixture of claim 12, wherein the lighting module has a distal end and further comprises:

a connector on the distal end to which an additional lighting sub module can be physically and electrically connected.

18. The lighting fixture of claim 17, further comprising:

a lighting sub module physically and electrically connected to the lighting module at the distal end via the connector.

19. The lighting fixture of claim 18, wherein the lighting sub module includes a motor to move the lighting sub module relative to the lighting module.

20. The lighting fixture of claim 1, wherein the transition plate is removably coupled to the lighting head.

21. The lighting fixture of claim 1, wherein a first portion of the at least one yoke can be moved, form a first position to a second position, relative to a second portion of the at least one yoke.

22. A transition plate for coupling to a lighting head of a lighting fixture, the transition plate comprising:

a first surface, dimensioned for coupling to a lighting head of a lighting fixture, a second surface, dimensioned and shaped with at least two connection locations so as to allow at least one lighting module to be removably physically and electrically coupled to the transition plate at either of the at least two connection locations, wherein the first surface includes at least one electrical contact element that will allow for electrical power to be uninterruptedly transferred from a contact on the lighting head to at least one lighting array, when the at least one lighting array is coupled to the transition plate and is controllably rotated, relative to the lighting head, through multiple revolutions.

23. A lighting fixture comprising a base;

at least one yoke, comprising at least one arm and a shaft, the at least one yoke being coupled to the base, and controllably, rotatably, moveable relative to the base;

a lighting head coupled to the at least one yoke, wherein the lighting head is controllably movable, relative to the at least one arm of the at least one yoke;

a removable transition plate having multiple connection ports through which power can pass from the lighting head to a lighting array, the lighting array comprising multiple lighting modules;

wherein the removable transition plate is removably coupled to the lighting head; and a continuous electrical path between the lighting head and lighting array via the transition plate.

24. The lighting fixture of claim 23, wherein the lighting head has a first extent at a lighting output side; and the lighting array has a second extent that is greater than the first extent.

25. The lighting fixture of claim 23, wherein the removable transition plate is rotatable relative to the lighting head.

26. The lighting fixture of claim 23, wherein the at least one yoke comprises a first yoke coupled to the base and to a second yoke, and the second yoke is coupled to the lighting head.

27. The lighting fixture of claim 23, wherein the multiple lighting modules are individually removably coupled to the removable transition plate.

28. The lighting fixture of claim 23, wherein the at least one yoke is releasably coupled to the base via the shaft.

* * * * *